US008323100B2

(12) United States Patent
Wollner

(10) Patent No.: US 8,323,100 B2
(45) Date of Patent: Dec. 4, 2012

(54) WAGERING METHOD FOR GAMES OF CHANCE INCLUDING TRUEPLACE AND FLAT BET RESOLVED CONCURRENTLY

(75) Inventor: Martin Wollner, Livonia, MI (US)

(73) Assignee: SpikerSystems LLC, Madison Heights, MI (US)

( * ) Notice: Subject to any disclaimer, the term of this patent is extended or adjusted under 35 U.S.C. 154(b) by 89 days.

(21) Appl. No.: 12/797,193

(22) Filed: Jun. 9, 2010

(65) Prior Publication Data

US 2011/0081960 A1 Apr. 7, 2011

Related U.S. Application Data

(60) Provisional application No. 61/248,976, filed on Oct. 6, 2009.

(51) Int. Cl.
*A63F 9/24* (2006.01)

(52) U.S. Cl. ..... 463/25

(58) Field of Classification Search ..... 463/25
See application file for complete search history.

(56) References Cited

U.S. PATENT DOCUMENTS

| | | | | |
|---|---|---|---|---|
| 5,782,472 | A * | 7/1998 | Brown | 273/274 |
| 5,829,748 | A | 11/1998 | Moore, Jr. | |
| 5,931,471 | A | 8/1999 | Bonito | |
| 6,394,901 | B1 | 5/2002 | Marta | |
| 6,655,689 | B1 | 12/2003 | Stasi | |
| 6,761,353 | B2 | 7/2004 | Berman et al. | |
| 6,802,508 | B2 | 10/2004 | Moody | |
| 6,817,614 | B2 | 11/2004 | Ibbertson | |
| 7,140,964 | B2 | 11/2006 | Walker et al. | |
| 7,229,352 | B2 | 6/2007 | Bonito | |
| 7,476,153 | B2 | 1/2009 | Walker et al. | |
| 7,524,244 | B2 | 4/2009 | Walker et al. | |
| 7,588,495 | B2 | 9/2009 | Walker et al. | |
| 2006/0035696 | A1 | 2/2006 | Walker et al. | |
| 2006/0160620 | A1 | 7/2006 | Matthews et al. | |

(Continued)

OTHER PUBLICATIONS

"Craps," Wikipedia, the free encyclopedia, Modified on Feb. 11, 2010, retrieved from Internet on Feb. 17, 2010. http://en.wikipedia.org/wiki/Craps.

*Primary Examiner* — William M. Brewster
(74) *Attorney, Agent, or Firm* — Endurance Law Group PLC

(57) ABSTRACT

A betting method used in a variety of games of chance, including but not limited to Craps. The method offers a variation of true odds bets referred to as TruePlace bets (TP) in which the pay-out ratio is equal to the probability of the forecasted outcome being randomly generated. A player make a prerequisite Flat bet (FB) and then is permitted to make any of several available TruePlace bets (TP), provided the amount placed at risk for the TruePlace bet (TP) does not exceed a calculated Amount Available. An outcome is randomly generating from the defined set of possible outcomes. The generated outcome is compared to the so that each respective bet (FB, TP) can be assessed as a win, loss or unresolved, which can be different for the Flat bet (FB) and TruePlace bet (TP). The Amount Available for TruePlace bets is (TP) defined by a TruePlace bets Pool less the sum of TruePlace bets already booked ($TP_B$). The method can be used as a vehicle to implement new and innovative strategies to offer player rewards intrinsically made via better player payouts.

21 Claims, 9 Drawing Sheets

U.S. PATENT DOCUMENTS

2006/0205461 A1 9/2006 LaRocca et al.
2007/0254732 A1 11/2007 Walker et al.
2008/0070679 A1 3/2008 Seelig et al.
2008/0200251 A1 8/2008 Alderucci et al.
2008/0287184 A1 11/2008 Boesen
2009/0061975 A1 3/2009 Ditchev
2009/0191962 A1 7/2009 Hardy et al.
2009/0203422 A1 8/2009 Ellis

* cited by examiner

WAGERING METHOD FOR GAMES OF CHANCE INCLUDING TRUEPLACE AND FLAT BET RESOLVED CONCURRENTLY

CROSS REFERENCE TO RELATED APPLICATIONS

This application claims priority to U.S. Provisional Application No. 61/248,976, filed Oct. 6, 2009, the entire disclosure of which is hereby incorporated by reference.

BACKGROUND OF THE INVENTION

1. Field of the Invention

The subject invention relates to a game of chance, and methods for playing games of chance, and wagering methods for games of chance, and more particularly to an improved system whereby methods of play include novel wagers enabling payback at true odds.

2. Related Art

Games of chance, such as Craps for example, are commonly played in casinos and now more frequently via electronic gaming terminals and in some jurisdictions via the Internet. Many current games of chance are familiar favorites that have a long and colorful history. The industry is starting to see a resurgence of table game popularity, as well as internet/electronic versions of these familiar old games. Clever variations in the wagering methods for many games of chance, like Craps as well as card games and other games of chance, is needed to further support an increase in the play of live games of chance as well as electronically delivered versions thereof and newly developed games of chance.

In order to describe the current need for improved wagering methods in many types of games of chance, it is useful to take a specific example. Some of the wagers made in the game of Craps will be used for this purpose. A detailed description of how these wagers are used in a typical Craps game follows.

The rules of play for the game of Craps, are generally the same in all jurisdictions in which the game is legally played. Also consistent is the table and equipment used to play the game in a live casino environment. A typical wagering layout for a Craps table is shown in FIGS. 1 and 2. Before the dice are rolled, any active player can make bets by placing chips on indicated wagering fields of table layout. These wagers and wager classes are well-known in the art and include: Pass-Line wagers; Don't Pass-Line wagers; Come-Line wagers; Don't Come-Line wagers; Pass-Line true odds wagers; Don't Pass-Line true odds wagers; Come-Line true odds wagers; Don't Come-Line true odds wagers; Field wagers; Big 6 and Big 8 wagers; Place wagers; Buy wagers; Lay wagers; Any 7 wagers; Any Craps wagers; Horn wagers; Hard-way wagers; and the like.

Each wager is associated with a pre-set payout ratio, meaning the proportion of money paid to the winner in relation to the amount placed at risk. Typical payout odds are shown in Table 1 below:

TABLE 1

TYPICAL PAYOUT ODDS - CRAPS

| Bet | True Odds | Odds Paid | House Edge |
|---|---|---|---|
| Pass/Come Line | 251:244 | 1:1 | 1.41% |
| Don't Pass/ Don't Come Line | 1031:949 | 1:1 | 1.36% |

TABLE 1-continued

TYPICAL PAYOUT ODDS - CRAPS

| Bet | True Odds | Odds Paid | House Edge |
|---|---|---|---|
| Pass Odds/ Come Odds | Same as paid | 2:1 on 4 or 10<br>3:2 on 5 or 9<br>6:5 on 6 or 8 | 0% |
| Don't Pass Odds/ Don't Come Odds | Same as paid | 1:2 against 4 or 10<br>2:3 against 5 or 9<br>5:6 against 6 or 8 | 0% |
| Yo (11) | 17:1 | 15:1 | 11.11% |
| 3 | 17:1 | 15:1 | 11.11% |
| 2 | 35:1 | 30:1 | 13.89% |
| 12 | 35:1 | 30:I | 13.89% |
| Hi-Lo | 17:1 | 15:1 | 11.11% |
| Craps | 8:1 | 7:1 | 11.11% |
| C & E | 5:1 | 3:1 on Craps<br>7:1 on 11 | 11.11% |
| Any 7 | 5:1 | 4:1 | 16.67% |
| Field | 5:4 | 1:1 on 3, 4, 9, 10 or 11<br>2:1 on 2 and 12 | 5.56% |
| Field | 5:4 | 1:1 on 3.4, 9, 10 or 11<br>2:1 on 2. 3:1 on 12 | 2.78% |
| The Horn | 5:1 | 27:4 on 2 or 12<br>3:1 on 3 or 11 | 12.5% |
| Whirl/World | 2:1 | 26:5 on 2 or 12<br>11:5 on 3 or 11<br>0:1 (push) on 7 | 13.33% |
| Hard way 4/ Hard way 10 | 8:1 | 7:1 | 11.11% |
| Hard way 6/ Hard way 8 | 10:1 | 9:1 | 9.09% |
| Big 6 | 6:5 | 1:1 | 9.09% |
| Big 8 | 6:5 | 1:1 | 9.09% |
| Place 4/Place 10 | 2:1 | 9:5 | 6.67% |
| Place 5/Place 9 | 3:2 | 7:5 | 4% |
| Place 6/Place 8 | 6:5 | 7:6 | 1.52% |
| Buy 4/Buy 10 | 2:1 | 2:1 + 5% commission | 4.76% |
| Buy 5/Buy 9 | 3:2 | 3:2 + 5% commission | 4.76% |
| Buy 6/Buy 8 | 6:5 | 6:5 + 5% commission | 4.76% |
| Lay 4/Lay 10 | 1:2 | 1:2 + 5% commission | 2.44% |
| Lay 5/Lay 9 | 2:3 | 2:3 + 5% commission | 3.23% |
| Lay 6/Lay 8 | 5:6 | 5:6 + 5% commission | 4.00% |

For the purposes of this specific example, the only important wagers are the Pass-Line, Don't Pass-Line, Come-Line, Don't Come-Line (collectively referred to as "Line" wagers), and the Place wagers.

In live Craps games, players typically make bets by placing chips in one or more of the wagering fields printed on the table layout (known as "self-serviced" bets), or by tossing chips onto the table and calling out the desired bet(s) (known as "dealer assisted" bets), or by making the equivalent selections in an electronic implementation such via a touch screen or computer keyboard. The table dealer's acceptance of a bet is known as "Booking" the bet, acknowledging to the house and to the player that the bet was made official. Booking of all bets on the entire table is finalized when the dealer calls out "All bets down," instructing that all players stop making or changing bets in order to allow the game to proceed.

The game of Craps is played in "Sessions." Each Session comprises the period of time one of the players, designated as "The shooter," rolls two indistinguishable dice at the same time. Each dice roll generates two random numbers selected from the group consisting of 1 through 6. The two generated numbers comprise the "Roll Result." The sum of the two numbers generated on a dice roll is the "Roll Sum," or simply the "Roll." A shooter's session will comprise at least one, and possibly many, "Rounds."

The first or initial roll of the dice within a Craps Round is called the "Come-Out Roll." The basic and most popular opening bet in the game of Craps, which is made just before the Come-Out Roll, is called the "Pass-Line Bet." Pass-Line Bets are instant winners when the roll-sum of the shooter's Come-Out Roll is 7 ("Big Red") or 11 ("YO") (collectively known as "Front-Line Winner"), and instant losers when the roll sum of the Come-Out Roll is 2 ("Snake Eyes"), 3 ("The Old One-Two"), or 12 ("Box Cars") (collectively knows as "Craps" or "Crapping-Out"). In all of these cases, (2, 3, 7, 11, 12), the shooter's next roll is deemed another Come-Out Roll, and the same shooter's session continues. Any other roll (4, 5, 6, 8, 9, or 10) becomes established as the current "Point Number," or simply the Point. A small round plastic marker ("the Puck") is usually used to indicate the currently established Point Number, and the table dealers then place the Puck upon the Craps table layout in a location that indicates the established Point Number. The Puck is placed upside-down in a neutral location before a Point is established, indicating that the next roll is a Come-Out roll.

To end a Round of Craps and resolve Pass-Line bets, once the Point Number is established, the shooter must roll either the current Point Number or a 7. Because unresolved Pass-Line Bets may not be decreased or removed, players must wait for a roll of either the Point Number or a 7 to determine the outcome of their Pass-Line bet; any other rolls have no bearing, and so an unpredictable amount of rolls is always required to resolve Pass-Line bets. If the Point Number is rolled (the number is "Repeated" or "Hit"), the Pass-Line bet wins (another way to be a "Front-Line Winner"), the current Round ends, the Puck is returned to the neutral position, and the same shooter continues his Session, wherein his next roll is another Come-Out roll. If a 7 is rolled, the Pass-Line bet loses ("Seven-Out" or "Seven-Ouch"), the current Round and the current Session ends, the Puck is returned to the neutral position, and the dice are passed on to the next shooter in clockwise rotation around the table to begin a new Session.

While a Point is established, players are not allowed to make new or additional Pass-Line bets. This is unfortunate, because many players at this stage would like the opportunity to make new or additional Pass-Line bets, especially given the possibility that many rolls could be required before the Round ends. To accommodate this desire while players wait an indeterminate amount of time for their Pass-Line bet to be resolved, the game of Craps provides "Come-Line" wagers. Players are allowed to make Come-Line bets only while a Point is established. These work exactly like Pass-Line bets, in that the first roll is an instant winner if a 7 or 11 is rolled, an instant loser if a 2, 3, or 12 is rolled, and any other number (4, 5, 6, 8, 9, 10) becomes the "Come Number" which these bets then win (if the Come number is rolled) or lose (if a 7 is rolled). Like Pass-Line bets, players are not allowed to reduce or remove Come Number bets once they are established. When a Come-Line bet is established, a table dealer moves the bet from the Come-Line wagering field on the table layout into a wagering field dedicated to the established Come Number.

This is not typically a self-serviced operation in live table game settings, meaning that the dealer must place the bet on the table layout. The reasons for this deal with issues of security. A given Come Number wagering field, as it usually appears on the average Craps table layout, is shaped like a square. Bets from multiple players must be kept separate from each other in this region of the wagering field. To do so, the stacks of chips for each player's bets are placed within the square according to their table position. Ensuring correct placement of these chip stacks, and preventing theft of other player's chips while the placement is being made, are the two primary reasons these betting operations are done only by table dealers. Of course, in electronic implementations such as touch screen betting, many of the otherwise manual dealer operations are done by the computer systems, and thus all electronic betting is made as self-serviced bets.

Comparing "dealer-assisted" bets with "self-serviced" bets in live table game settings, nearly all self-serviced bets are made in large wagering field areas that span the length of the table, enabling players to place their betting chips within these wagering fields directly in front of their table position. As shown in FIG. 2, the only exception to this is the "Don't Come-Line" wagers, which is large enough to accommodate multiple stacks of player chips, and it is left to the players to place their bets in the area without interfering with other player bets in the same wagering field.

Pass-Line bets and Come-Line bets, both for which Points are first established, are referred to as "Committed," meaning they cannot be reduced or removed prior to resolution. Instead, the player must either wait for the resolution or he can "Surrender" the bet to the house, for example, if a shooter has rolled for a long time without resolution and the player needs to leave the casino. Craps rolls have been known to last more than 2 hours, during which time aggressive players can win substantial amounts of money. This is one of the reasons that Craps is very popular; players have an increased opportunity to win large sums if the current shooter has an extended roll session. This is sometimes referred to as a "Hot Roll."

In addition to Pass-Line bets, players may make Don't Pass-Line bets, which work almost the opposite of Pass-Line bets. On the Come-Out Roll, a 7 or 11 are instant losers, a 2 or 3 are instant winners. If a Point Number is established by a roll of 4, 5, 6, 8, 9, or 10, the bet wins if a 7 is then rolled, and loses if the Point Number is then rolled. If a 12 is rolled on the Come-Out Roll, the Don't Come-Line bet is unaffected (also called a "Push"). Thus, the Don't Pass-Line bets are not completely opposite of Pass-Line bets. This is done in order for the house to maintain an edge on Don't Pass-Line bets.

Lastly among the Line bets, Don't Come-Line bets (known as "DC" bets) are available which are only allowed to be made while a Point is established; a roll of 7 or 11 are instant losers, 2 or 3 are instant winners, 12 is a push, 4, 5, 6, 8, 9, and 10 become the DC Number, which then wins if a 7 is rolled and loses if the DC Number is repeated. Pass/Don't Pass-Line and Come/Don't Come-Line bets are also referred to collectively as "Flat Bets" and "Base Bets."

In most versions of the game of Craps, a player is permitted to make bets on some addition sets of wagers, all of which payout at true odds. A wager on a specific result that is won at true odds pays the player who made the wager according to the true odds of the specific result occurring. In Craps, for example, a player who has made a Pass-Line Bet for which a Point Number becomes established may then optionally make a separate bet known as the "true odds" bet on the established Point Number being rolled before a 7 is rolled. Similar true odds wagers are available to players after making Don't Pass-Line, Come-Line, and Don't Come-Line bets. True odds bets, or as sometimes referred to as "free odds bets," are thus continuation bets that players can optionally make as an addition to one of the established Flat Bets. Each true odds bet is associated with the Flat Bet from which it continues on a 1-to-1 basis.

If, for example, $10 is wagered on the Pass-Line, once the Point is established the player then has the option to make the additional true odds bet associated with the Pass-Line's established Point. One could, for example, make a true odds bet of $20 on the true odds wager. There would now be a total of $30 at risk on the table and the player would win and lose both the original Pass-Line Bet and the true odds Bet in the same way the Pass-Line Bet is won and lost. In some respects, true odds Bets are similar to the double option in blackjack, in that the bet is optionally made in the middle of the game sequence. There are no known examples of popular table/casino games that provide true odds wagering options at the start of game play.

The amounts a player can bet on true odds wagers vary from casino to casino, and are usually limited to a ratio of the amount of the original associated Pass/Don't Pass-Line, or Come/Don't Come-Line bet (the Flat Bet), in respect to the true odds bet. This ratio is usually somewhere between 1 and 100 times the original Flat Bet. Casinos that offer Craps usually prominently advertise their true odds ratio to entice players into the establishment. For example, a casino may advertise "2 Times Odds" (also called "2×Odds" or "Double Odds"), "Triple Odds," "10 Times Odds," "100×," etc. Another very popular wagering variation is known as "Stacked Odds." For example, a casino may offer 3× on the 4 and 10 Points, 4× on the 5 and 9 Points, and 5× on the 6 and 8 Points. This particular example is known as the "Golden Triangle" as it is often compared to right triangles used in geometry. An important distinction here is the payout odds established for various wagers in a Craps game vs. the maximum ratio players are allowed to bet on true odds bets in proportion to the Flat Bets from which they continue; limitations on the amount a player is permitted to bet is completely independent from the payout ratio that the player will receive if their bet is won.

Unlike committed Pass-Line and Come-Line bets, true odds bets are not committed. True odds bets can be changed or removed at any time, whereas the original Pass-Line or Come-Line Flat bets cannot be reduced or removed once they are committed. However, this is not to be confused with Don't Pass-Line bets and Don't Come-Line Bets, as well as any true odds bets continued from these, which are all allowed to be reduced or removed. In fact, it is to the house's advantage to allow reduction or removal of these latter bets.

The reason that true odds bets are appealing to savvy players is that these bets are paid out at true odds. That is, the casino has no edge on true odds bets and therefore makes no profit from them. True odds bets are the only bets a player can make in typical casinos with 0% house edge. In theory, a player could play forever and never lose if the house has no edge. For this reason, true odds bets are especially popular with knowledgeable players.

In addition to the Line wagers described above, typical Craps games offer several other wagers that can be classified as "Single-Roll" wagers. The outcome of a Single-Roll wager is entirely decided, win or lose, upon a single roll of the dice. One popular example of a Single-Roll wager is the "Field" bet, where the player instantly wins if a 2, 3, 4, 9, 10, 11, or 12 is rolled, and instantly loses if a 5, 6, 7, or 8 is rolled. Other "Single-Roll" wager examples include what are known as "Proposition" bets such as "Yo-11," "Box Cars," "Any Craps," and "Big Red."

In addition to Line wagers and "Single-Roll" wagers, typical Craps games offer several other wagers, all of which can be classified as "Persistent" wagers. A Persistent wager is one in which the outcome may be decided, win or lose, upon a single roll of the dice, or the bet may be a push and persist until the outcome is resolved or the bet is removed. Popular examples of Persistent wagers include all of the "Place" wagers, where players win if the particular Place number is rolled, lose if a 7 is rolled, and the bet(s) persists if neither is rolled. Other examples include all of the "Hard-Way" bets.

The Line wagers (Pass-Line, Don't Pass-Line, Come-Line, and Don't Come-Line) all have the common distinction that players making these bets have no control over the Point Number that gets established. This is the source of the term "Come bet," meaning that the bet will be on whatever Point Number comes. However, those skilled in the art are well aware that players often have a personal favorite number and may prefer to bet on that favorite number as a roll sum. For this reason, the "Place" bets are provided. Place bets allow players to directly make bets on any of a specific roll sum, e.g., on their favorite number, regardless of the current Point Number at the table. However, Place bets all have a built-in house edge that exceeds the payouts made for Line bets. This is especially the case if players take advantage of "true odds" bets, as described above. And thus, Craps players are always faced with a dilemma to either make bets with better paybacks on whatever numbers come (Line bets), or to make bets directly upon preferred numbers (Place bets) which have less favorable paybacks (i.e., greater house edges).

The following example shows how this dilemma can prevent a player from betting on his preferred numbers, and serves as an example of how the game of Craps is played using Line bets and making the true odds continuation bets associated with them (known as "taking odds").

The "Dilemma" Example

In this example, a casino is offering 10 times odds, meaning that the maximum true odds bet amount allowed is 10 times the amount of the associated Flat Bet. A player makes a $10 bet on the self-serviced Pass-Line wager during a Come-Out roll, and it is booked by the house when the dealer calls "All bets down." A shooter rolls a 4 as their Come-Out Roll, thus establishing 4 as the table's current Point number, and committing the player's $10 Pass-Line bet to be won, lost, or surrendered upon subsequent action.

At this juncture, the player is allowed to make up to a $100 true odds continuation bet on the Pass-Line true odds wager (i.e., $10 times 10× odds). The player in this example opts to make a $50 true odds bet, self-serviced on the Pass-Line true odds wagering field, and also makes a self-serviced $10 Come-Line bet. The shooter rolls a 9, and this does not affect the player's original $10 Pass-Line bet or his $50 Pass-Line true odds bet, but it does commit the $10 Come-Line bet to the Come Number 9. The dealer moves this latter $10 bet from the Come-Line wagering field on the table layout into the wagering field dedicated to the established number 9, known as "Come 9," thus booking it.

The $10 Come-Line bet entitles the player to make up to a $100 true odds continuation bet on the Come 9 true odds wager. The Player makes opts to make a $50 true odds bet, tossing the money on the table and yelling to the dealer "Odds on the Come 9!", which the dealer accepts and books for the player. The player now has the following bets booked:

- $10 Pass-Line (committed)
- $50 Pass-Line true odds (allowed to be increased up to $100 or reduced or removed)
- $10 Come-9 (committed)
- $50 Come-9 true odds (allowed to be increased up to $100 or reduced or removed)

The shooter then throws a series of rolls as follows: 5, 6, 8, 6, 6, 5, 8. None of these rolls have any effect upon the bets booked for the player. Finally, the shooter throws a 7, and the player losses all of his bets, totaling $120 in losses. This is known as "7-Out" or "Table-Out," ending the round and the session. The player is very dissatisfied with this gaming experience, due to the fact that he really prefers to bet on the 6 and 8 numbers (the easiest numbers to repeat). But rather than making Place bets on these favorite numbers, the player chose to make Line bets, which resulted in him betting on the 4 and 9, the two numbers that happened to come when his Line bets were made. The player was encouraged to use this strategy because it offered a better payback potential, but lost because of the 4 and 9 numbers, relatively hard to repeat compared to a 6 or 8, did not repeat before the 7 was rolled.

There is a need in connection with games of chance to provide betting options that pay at true odds for specifically chosen wagers, such as a player's favorite number(s) for example, or a number for which the player simply has a hunch will next occur. In the past, this capability has been widely ignored because of the complexity involved in booking these types of wagers in live multi-player games. There have been prior art attempts to capitalize on the popularity of true odds bets by varying the wagering rules in certain games of chance to more fully exploit the very attractive nature of wagering with 0% house edge. However, these prior art attempts have always required a prerequisite bet containing a house edge, and been limited so as to manage the overall complexity.

For example, U.S. Pat. No. 6,802,508 (Moody) discloses a method of playing Craps including a hard way true odds bet. In a hard way true odds bet, when a player makes a Pass-Line Bet and a Point Number is established, the player may make a hard way true odds Pass-Line Bet. When a dice roll having the roll sum of the Point Number and having each generated number being the same value (hard-way) is rolled before a dice roll having the roll sum of 7, a player having a hard way true odds Pass-Line Bet wins an amount according to the true odds of that dice roll being rolled. When a dice roll having the roll sum of 7 is rolled before a dice roll having the roll sum of the Point Number and having each generated number being the same, a player having a hard way true odds Pass-Line Bet loses his true odds Pass-Line Bet.

U.S. Pat. No. 6,761,353 (Berman) discloses a method of playing a dice game. In this patent, a player first makes a "Four the Money Wager" that no roll sum of the next four dice rolls will be seven. A player making the "Four the Money" wager may also make a "Four the Money" true odds wager on any of the roll sums of 2, 3, 4, 5, 6, 8, 9, 10, 11, or 12. A player having a "Four the Money" true odds wager on one of the roll sums when that roll sum is rolled will win an amount according to the true odds of a dice roll having that roll sum being rolled. What is needed in the art is a way for players, for example, Craps players, to make bets that pay at true odds and to be able to make these bets directly upon preferred numbers and/or other wagers. In other words, to provide the best of both worlds between Line bets and Place bets, as well as making other bets available at true odds.

SUMMARY OF THE INVENTION

According to a first aspect of this invention, a method for playing a game of chance having various wagering options is provided. In this embodiment, at least one game of chance is provided in which a game decision is selected from a defined set of possible outcomes, each possible outcome having a specific probability of being randomly generated in the course of game play. A plurality of wagering options is provided, each based on a forecast for a particular outcome from the defined set. Each wagering option guarantees a return in the event of a win determined by a pre-set payout ratio multiplied by a value placed at risk. The wagering options include: at least one Flat bet (FB) in which the pay-out ratio is less than the probability of the forecasted outcome being randomly generated; and at least one TruePlace bet (TP) in which the pay-out ratio is equal to the probability of the forecasted outcome being randomly generated. At least one player is provided, and from this player at least one Flat bet (FB) is received together with an accompanying value at risk, and also at least one TruePlace bet (TP) together with an accompanying value at risk. Then, an outcome is randomly generating from the defined set of possible outcomes. The generated outcome is compared to the Flat bet (FB) and TruePlace bet (TP), so that each respective bet (FB, TP) can be assessed as a win, loss or unresolved. The forecasted outcome for the TruePlace bet (TP) is dissimilar to the forecasted outcome for the Flat bet (FB), whereby the TruePlace bet (TP) is not directly associated with the Flat bet (FB) such that the generated outcome may yield a different resolution for the TruePlace bet (TP) and the Flat bet (FB).

According to another aspect of this invention, a method for playing a game of chance having various wagering options is provided. In this aspect, at least one game of chance is provided in which a game decision is selected from a defined set of possible outcomes, each possible outcome having a specific probability of being randomly generated in the course of game play. A plurality of wagering options is provided, each based on a forecast for a particular outcome from the defined set. Each wagering option guarantees a return in the event of a win determined by a pre-set payout ratio multiplied by a value placed at risk. The wagering options include: a plurality of Flat bets (FB) in which the respective pay-out ratios are less than the probability of the respective forecasted outcomes being randomly generated; and a plurality of TruePlace bets (TP) in which the respective pay-out ratios are equal to the probability of the respective forecasted outcomes being randomly generated. At least one player is provided, and from this player at least one Flat bet (FB) is received together with an accompanying value at risk, and also at least one TruePlace bet (TP) together with an accompanying value at risk. Then, an outcome is randomly generating from the defined set of possible outcomes. The generated outcome is compared to the at least one Flat bet (FB) and at least one TruePlace bet (TP), so that each respective bet (FB, TP) can be assessed as a win, loss or unresolved. A TruePlace bets pool is established for the player according to the formula: TruePlace Pool=$\Sigma$ (FB*$r_{FB}$), where: FB=each committed Flat bet, and $r_{FB}$=a ratio defining the maximum TruePlace bet allowed for the particular Flat bet (FB).

The invention provides methods for playing games of chance, and more specifically wagering methods for games of chance that can be applied across a spectrum of game types and implementation strategies, including live table operations as well as computer-assisted and internet-delivered technologies. The invention offers is a new class of wagers defined as TruePlace bets Like the traditional true odds bets, TruePlace bets require a prerequisite Flat bet with the maximum amount of a TruePlace bet preferably limited to a ratio ($r_{FB}$) of a single prerequisite Flat bet. A distinguishing characteristic of TruePlace bets, however, is that there can be a plurality of TruePlace bets optionally made from a plurality of Flat bets. In other words, TruePlace bets offer a many-to-many (unconstrained) relationship with respect to the prerequisite Flats bets.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
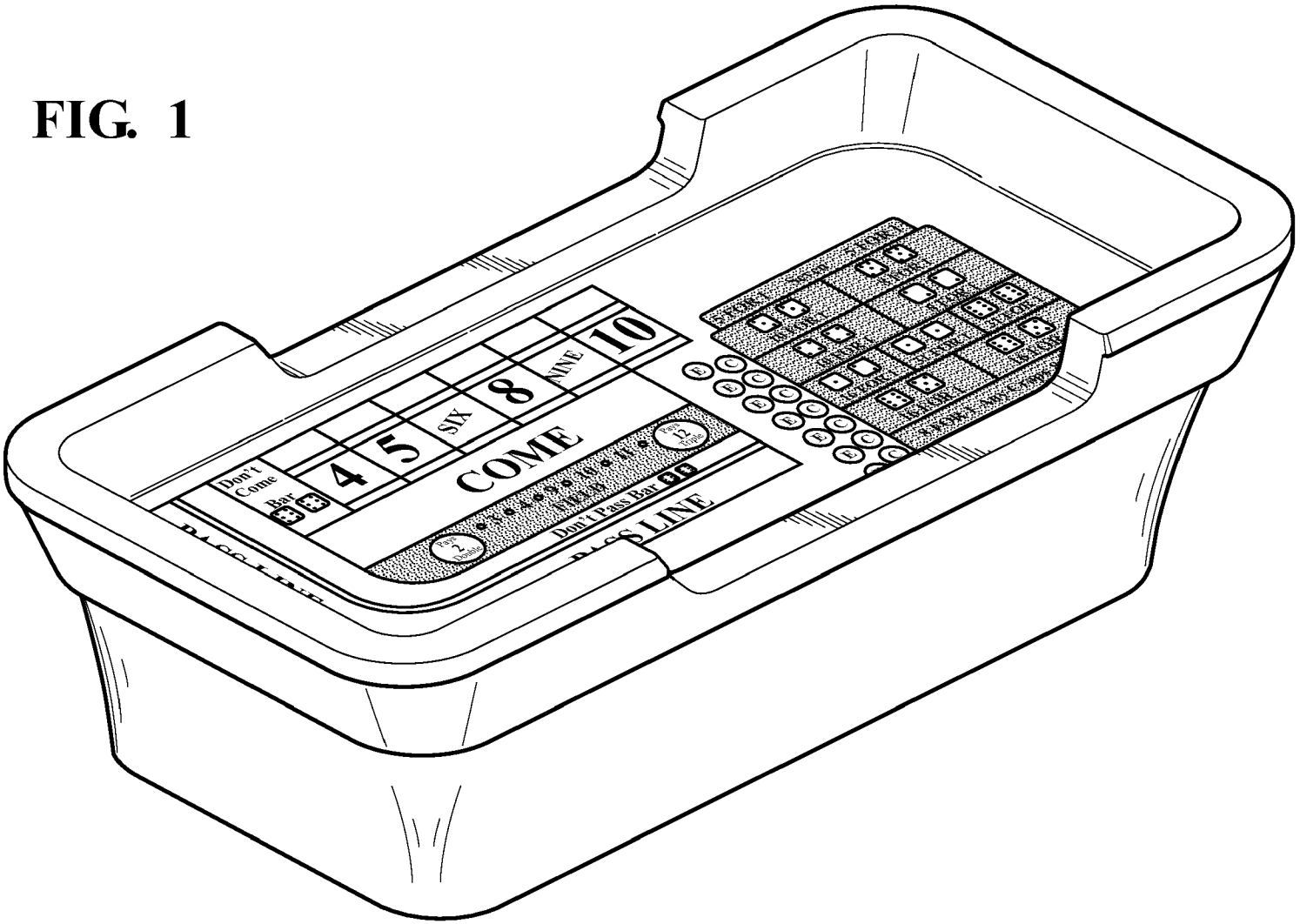
FIG. 1 is a perspective view of a typical live Craps gaming table such as may be used in one embodiment of this invention.
Figure 2:
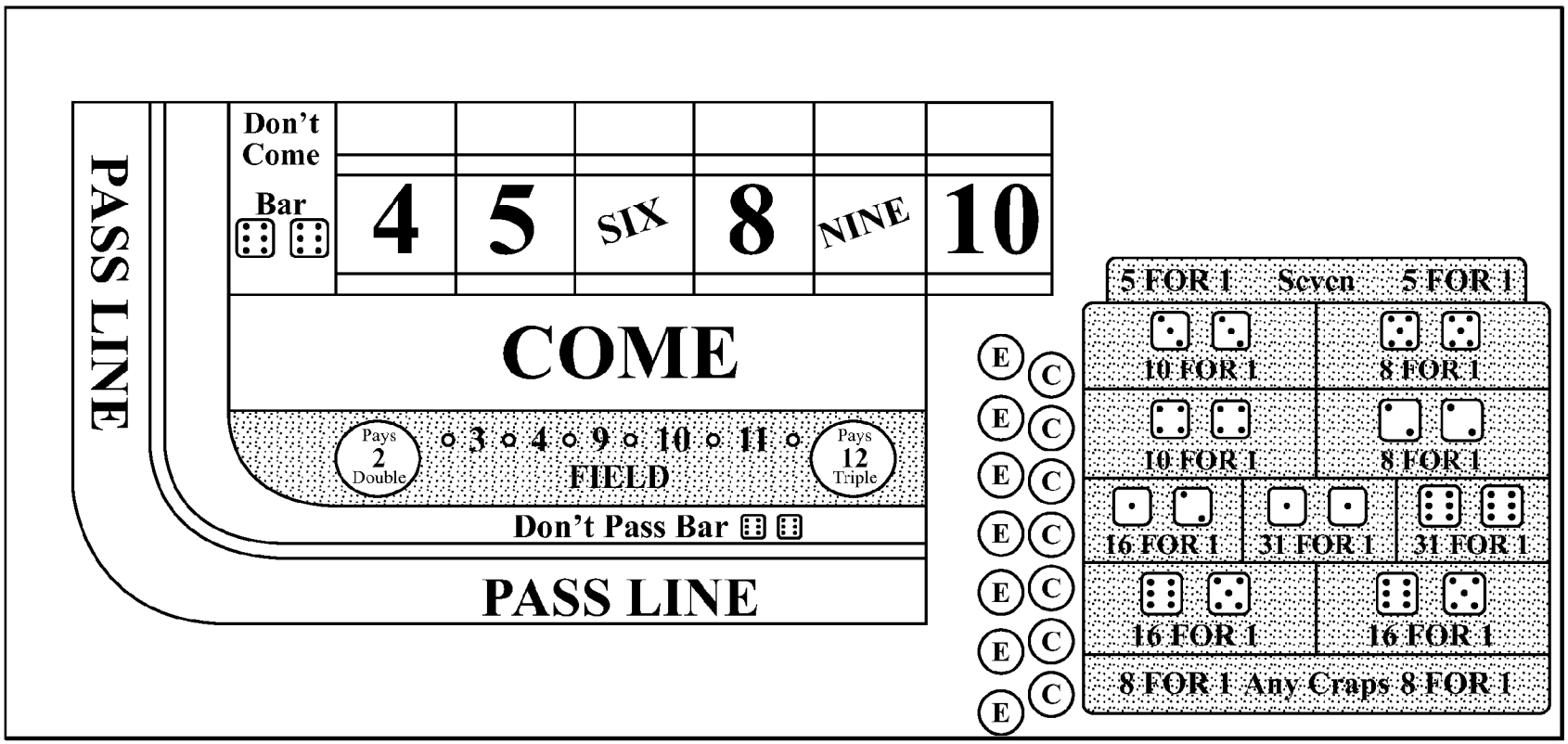
FIG. 2 is a plan view of a table layout for a typical Craps game of chance.

A game of chance according to this invention, and methods for playing games of chance, and wagering methods for games of chance according to this invention may take many forms and are not limited to the specific game of Craps, nor to any technologies used for its implementation, including traditional manual live table operations and/or computer-assisted technologies. However, the game of Craps serves as a convenient context for explaining how a game of chance and wagering methods according to this invention may be implemented. A live Craps game is played in the manner described above and shown, for example, in FIGS. 1 and 2. The invention pertains to the optional continuation bets resulting from committed Flat bets such as Line and Put bets that are offered as a form of true odds bets.

The invention is a new class of wagers referred to herein as "TruePlace" bets. Like the traditional true odds bets, TruePlace bets require a prerequisite Flat bet. The maximum amount of a TruePlace bet is preferably limited to a ratio of a single prerequisite Flat bet, just like true odds bets. However, TruePlace bets are distinguished from true odds bets in that there can be a plurality of TruePlace bets optionally made from a plurality of Flat bets. True odds bets are constrained by their associated Flat bets on a 1-to-1 relationship, but there is a many-to-many (unconstrained) relationship between Flats bets and TruePlace continuation bets.

As an example of this relationship constraint that exists with true odds bets but not with the TruePlace bets of this invention, assume a Craps table (FIGS. 1 and 2) that offers 10 times odds. When a player's $10 Line bet is committed, he has permission to make (up to) a $100 true odds bet upon the one and only true odds wager associated with the $10 Flat Bet. If the player has two separate Line bets committed, each for $10 as the "Dilemma" Example above showed, the player has permission to make $200 in true odds bets—constrained to $100 for each of the associated true odds wagers. However, if the Craps table implements the invention of TruePlace bets, that $200 can be bet across the player's choice of several TruePlace bets rather than be limited only to the two true odds bets directly associated with the Flats.

The TruePlace bets invention works by examining all of the Flat bets committed for the player and summing this amount into a Pool. The "Amount Available For TruePlace bets" is equal to the Pool less any concurrent (i.e., previously booked) TruePlace bets. The dollar balance is then available to be made on the basis of the player's choice for any TruePlace wager supported by the game. Specifically, the Amount Available For TruePlace bets can be expressed by the mathematical formula:

$$\text{Amount Available For TruePlace bets} = \text{TruePlace Pool} - \Sigma(TP_B)$$

Where:

TruePlace Pool=$\Sigma(FB*r_{FB})$

FB=each committed Flat bet $r_{FB}$=the ratio defining the maximum true odds bet allowed for the particular Flat bet (FB)

$TP_B$=TruePlace bets already booked

Figure 3:
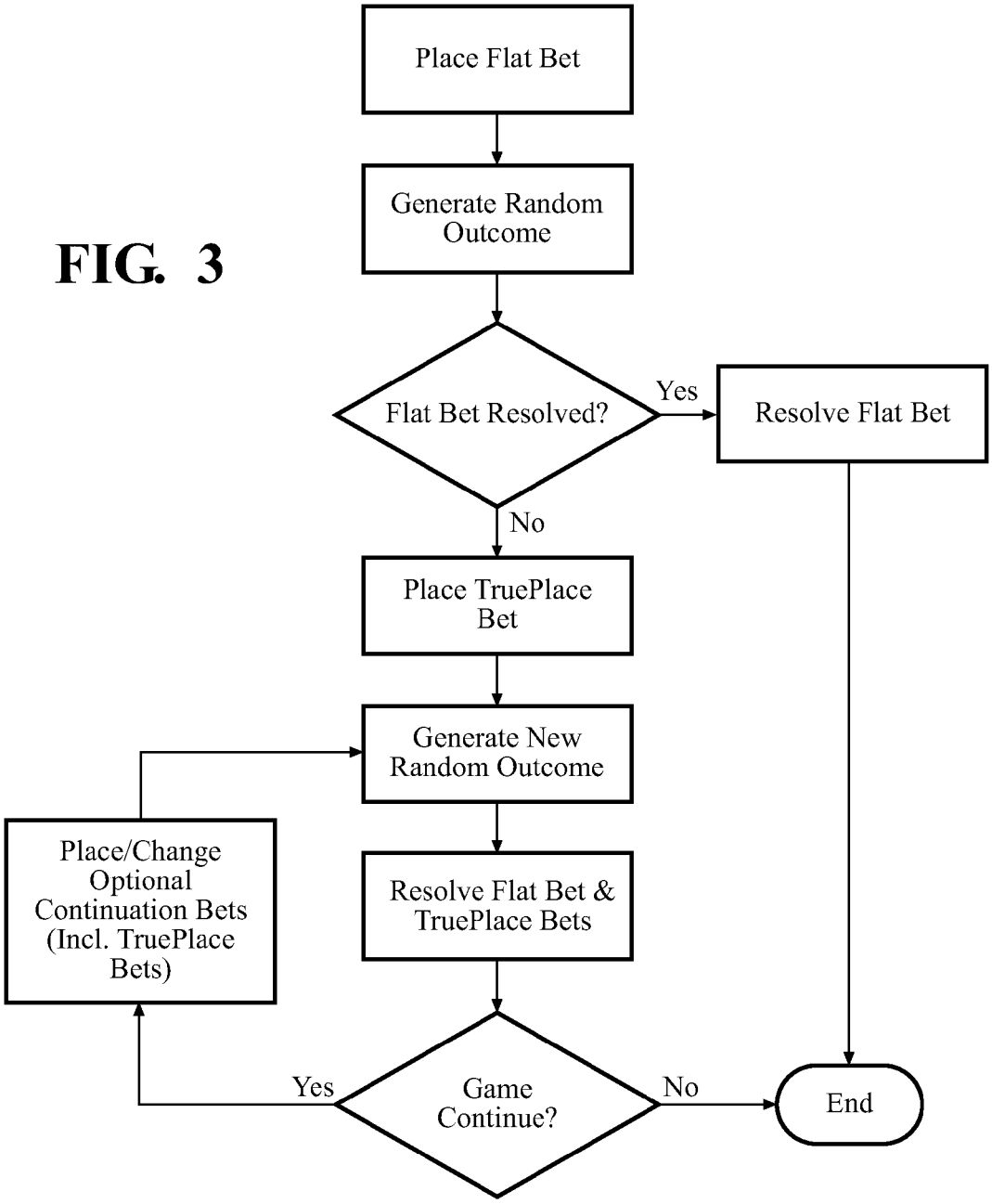
FIG. 3 is a flow chart describing a basic playing method for a game of chance according to this invention.
Figure 4:
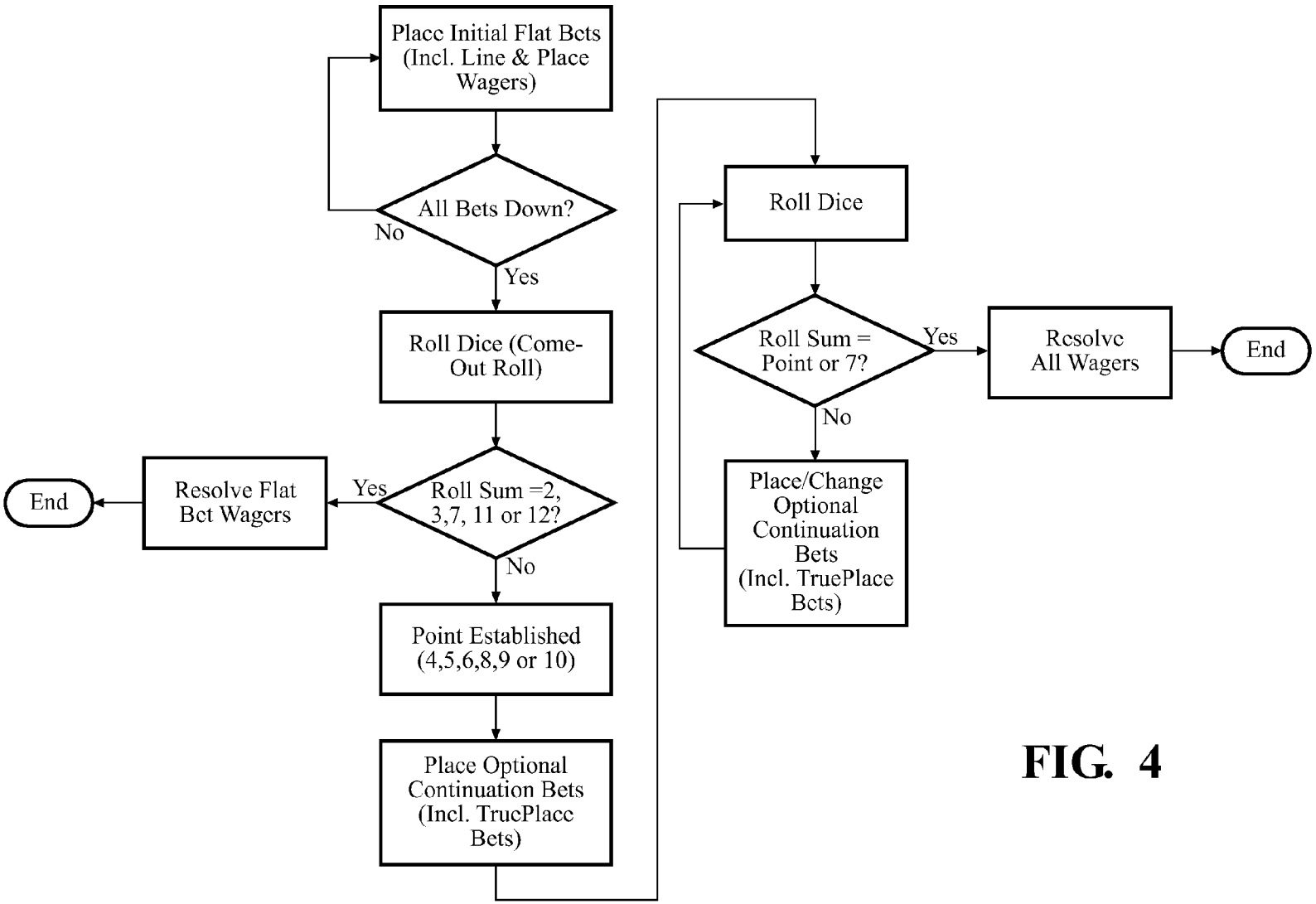
FIG. 4 is a flow chart describing a method for playing a Craps-like game of chance according to this invention.

A Player can pick and choose which TruePlace bets he desires to make according to this concept. In the preferred implementation of this invention, the number of TruePlace bets a player can make is not limited, however the quantity is limited. More specifically, a player may spread their bets among any and all TruePlace bets offered, provided they do not exceed the Amount Available For TruePlace bets balance established by the equation given above. FIG. 3 is a flow chart describing a basic playing method for a game of chance according to this invention. FIG. 4 is a flow chart describing the TruePlace betting method in a more specific implementation for a Craps-like game of chance.

In addition, the amount the player can bet upon a single TruePlace wager may very well exceed the maximum that would have been calculated for comparable true odd bets. For example, a player could have five Flat bets committed for $10 each on a 10 times odds table, establishing initially a $500 Amount Available For TruePlace bets. The player could use this $500 pool limit to make a single $500 wager on any TruePlace betting opportunity available in the game, provided of course that the player does not have any other concurrent TruePlace bets. Note, however, that the house usually imposes maximums on various bets made, and the TruePlace wagers may be likewise limited in such circumstances. Table minimums can be applicable to TruePlace bets as with all other betting options. The house-established minimums and maximums are preferably applied to individual bets and also to the sum of total bets made by a player.

The following example follows the "Dilemma" Example above, but provides a set of TruePlace wagers as replacements to the Pass-Line true odds wager and all of existing Come-Number true odds wagers provided in that game.

TruePlace Variation of the Dilemma Example

The TruePlace wagers in this example game include:

1. TruePlace Pass-Line Odds (replaces the Pass-Line true odds Bet)
2. TruePlace 4 Free Odds (replaces the Come 4 true odds Bet)
3. TruePlace 5 Free Odds (replaces the Come 5 true odds Bet)
4. TruePlace 6 Free Odds (replaces the Come 6 true odds Bet)
5. TruePlace 8 Free Odds (replaces the Come 8 true odds Bet)
6. TruePlace 9 Free Odds (replaces the Come 9 true odds Bet)
7. TruePlace 10 Free Odds (replaces the Come 10 true odds Bet)

According to this example, assume the casino is offering 10 times odds, meaning that 10 times the amount of the each of the committed Flat Bets is added into the "Amount Available For TruePlace bets" pool balance, and thus becomes available for betting on any or all of the TruePlace wagers enumerated above. A player makes a $10 bet on the self-serviced Pass-Line wager during a Come-Out roll, and it is booked by the house when the dealer signals "All bets down." The shooter rolls a 4 as his Come-Out Roll, thus establishing 4 as the table's current Point Number, and committing the player's $10 Pass-Line bet to be won, lost, or surrendered upon subsequent action.

The formula for determining the balance available for TruePlace bets is calculated as: (The sum of (each committed Flat Bet TIMES the ratio defining the maximum true odds bet allowed for the particular Flat Bet)) MINUS (the sum of all TruePlace bets already booked). In this example, at this stage in the game, the Amount Available For TruePlace bets is the entire TruePlace Pool=$100=(The sum of (($10 Flat Bet on the Pass-Line for the current Point Number 4)*10)) MINUS ($0). And so, at this juncture, the player is allowed to make up to $100 in TruePlace continuation bets among any and all of the TruePlace wagers provided in this example game.

The Player in this example is assumed to favor the 6 and 8 numbers, and therefore opts to make a $25 TruePlace 6 Free Odds bet and a $25 TruePlace 8 Free Odds bet. The player also chooses to make a $10 Come-Line (continuation) bet. All of these bets are booked the instant the dealer signals "All bets down," which may be accomplished electronically from a dealer control console touch screen in some cases.

Continuing in this example, the shooter rolls a 9, and this does not affect the player's original $10 Pass-Line bet, or his $25 TruePlace 6 Free Odds bet, or his $25 TruePlace 8 Free Odds bet, but it does commit the $10 Come-Line bet to the number 9. The $10 bet is moved from the Come-Line wagering field into the wagering field dedicated to the established Come Number 9 thus booking it, which may be accomplished via an electronic table layout.

The Available Amount for TruePlace bets formula is re-calculated, and the new balance available for TruePlace bets now=$150=(The sum of (($10 Flat Bet on the Pass-Line for the current Point Number 4)*10) PLUS (($10 Flat Bet on the Come 9)*10)) MINUS ($25+$25). At this time, the player is allowed to make up to an additional $150 in TruePlace continuation bets among any and all of the TruePlace wagers provided in the game. Note that the Available Amount for TruePlace bets formula is re-calculated every time the player makes any wagering changes and also whenever the game state changes, for example, when the dice are rolled and payouts are made.

Because this player has a special affinity for the 6 and 8 numbers, he opts to make an increase (also know as "Pressing" a bet) of $25 to the TruePlace 6 Free Odds bet, and a $25 press to the TruePlace 8 Free Odds bet. As a result, these two TruePlace bets are now $50 each, leaving $100 from the pool still available for TruePlace bets. The player now has the following bets booked:

$10 Pass-Line (committed)
$50 TruePlace 6 Free Odds bet (allowed to be increased up to $150, reduced or removed)
$10 Come-9 (committed)
$50 TruePlace 8 Free Odds bet (allowed to be increased up to $150, reduced or removed)

In this example, as in the preceding "Dilemma" Example, the shooter then throws a series of rolls as follows: 5, 6, 8, 6, 6, 5, 8. Because the player had $50 bets booked on the TruePlace 6 and TruePlace 8 Free Odds bets, this series of rolls pay him as follows:

5 (Five): (No effect)
6 (Six): Win $60 because the true odds of the 6 pays 6 to 5
8 (Eight): Win $60 because the true odds of the 8 pays 6 to 5
6 (Six): Win $60 because the true odds of the 6 pays 6 to 5
6 (Six): Win $60 because the true odds of the 6 pays 6 to 5
5 (Five): (No effect)
8 (Eight): Win $60 because the true odds of the 8 pays 6 to 5

Finally, the shooter throws a 7 and the player losses all of his bets, totaling $120 in losses. However, the player has accumulated $300 in winnings during this Round. Therefore, the net balance for this player during this Round is +$180. This net winning can be compare to the net loss (−$120) incurred in the "Dilemma" Example using the same series of dice rolls (4, 9, 5, 6, 8, 6, 6, 5, 8). According to the TruePlace bets option provided by this invention, the player not only has a net win, but also enjoyed the playing experience more due to the fact that he was able to bet on certain favorite numbers without sacrificing the customary reduced payback ratio.

Note that in the above example, had the player instead made prior art style Place bets of $50 each directly on the 6 and 8 (which pay out at 7 to 6 odds), rather than making these as $50 TruePlace bets, his balance for this Round would have been +$171.60. This sum is less than the +$180 offered by the TruePlace bets method because of the house edge charged for making traditional Place bets. Thus, TruePlace bets offers an increase of 4.8% overall over traditional Place bets in this example, coupled with a more enjoyable playing experience. These differences between TruePlace bets and traditional Place bets will encourage all players, but perhaps especially the most knowledgeable and committed players, to play longer.

The invention is intended for use with any and all Line bets offered in a game. For example still within the context of Craps, a player having a Don't Come wager when a Point is established may make any TruePlace Don't Come Free Odds wager available effective on the next dice roll. (Although it is contemplated that a player will be allowed to make any TruePlace bet available in the game, for the purposes of this example the player is assumed to want to keep all bets on the Don't side.) If a subsequent roll is a 7, the player wins an amount according to the true odds of the wagered roll sum result being rolled.

Use of TruePlace Bets in Concurrently Mapped Games of Chance

The TruePlace betting method may be used in connection with games of chance other than Craps, as well as with concurrently played dissimilar games of chance. For example, US Patent Publication Number 2010/0019447 to M. Wollner, published Jan. 28, 2010, discloses a method for mapping the outcome of one random event to determine the outcome of another event concurrently. The entire disclosure of US 2010/0019447 is hereby incorporated by reference and relied upon. For example, a 36, 37, or 38-position roulette wheel spin may be mapped into the result of a 2-dice roll as using either distinguishable dice or non-distinguishable dice. Or, the outcome of a 2-dice roll using distinguishable dice can be mapped into the results of a 1-to-18 range game and to 1-to-9 range game all at the same time. Thus, the TruePlace wager concept can be applied to non-Craps games of chance, and among and between different games of chance.

Referring to Table 19 in the above-noted US 2010/0019447, one exemplary mapping between a game of Craps using two distinguishable dice as the game's randomization source and the games of TruePlace Rock-Paper-Scissors (shown as a 1-to-3 map) and TruePlace Coin-Flip (shown as a 1-to-2 map) is provided. The following Table 2 shows these mappings and in addition the mapping ranges for 1-to-18, 1-to-9, 1-to-6 and 1-to-4:

TABLE 2

Mapping from 2 (Distinguishable) Dice Rolls into Other Ranges

| 2-Dice | 2-D Point | 1-to-18 | 1-to-12 | 1-to-9 | 1-to-6 | 1-to-4 | 1-to-3 | 1-to-2 |
|---|---|---|---|---|---|---|---|---|
| 1-1 | 2 | 1 | 1 | 1 | 1 | 1 | 1 | 1 |
| 1-2 | 3 | 2 | 1 | 1 | 1 | 1 | 1 | 1 |
| 1-3 | 4 | 3 | 2 | 1 | 1 | 1 | 1 | 1 |
| 1-4 | 5 | 4 | 4 | 2 | 2 | 1 | 1 | 1 |
| 1-5 | 6 | 5 | 5 | 3 | 2 | 2 | 1 | 1 |
| 1-6 | 7 | 6 | 6 | 5 | 4 | 2 | 2 | 2 |
| 2-1 | 3 | 7 | 7 | 1 | 1 | 1 | 1 | 1 |
| 2-2 | 4 | 8 | 8 | 1 | 1 | 2 | 1 | 1 |
| 2-3 | 5 | 9 | 9 | 3 | 2 | 1 | 1 | 1 |
| 2-4 | 6 | 10 | 10 | 4 | 3 | 2 | 2 | 1 |
| 2-5 | 7 | 11 | 11 | 6 | 4 | 3 | 2 | 2 |
| 2-6 | 8 | 12 | 12 | 5 | 3 | 2 | 2 | 1 |
| 3-1 | 4 | 13 | 1 | 2 | 1 | 1 | 1 | 1 |
| 3-2 | 5 | 14 | 2 | 3 | 2 | 1 | 1 | 1 |
| 3-3 | 6 | 15 | 3 | 4 | 3 | 3 | 2 | 1 |
| 3-4 | 7 | 16 | 4 | 6 | 4 | 3 | 2 | 2 |
| 3-5 | 8 | 17 | 5 | 7 | 5 | 3 | 3 | 2 |
| 3-6 | 9 | 18 | 6 | 8 | 5 | 4 | 3 | 2 |
| 4-1 | 5 | 1 | 7 | 2 | 2 | 1 | 1 | 1 |
| 4-2 | 6 | 2 | 8 | 4 | 3 | 2 | 2 | 1 |
| 4-3 | 7 | 3 | 9 | 6 | 4 | 3 | 2 | 2 |
| 4-4 | 8 | 4 | 10 | 4 | 3 | 3 | 2 | 1 |
| 4-5 | 9 | 5 | 11 | 7 | 5 | 4 | 3 | 2 |
| 4-6 | 10 | 6 | 12 | 8 | 6 | 4 | 3 | 2 |
| 5-1 | 6 | 7 | 1 | 3 | 2 | 2 | 1 | 1 |
| 5-2 | 7 | 8 | 2 | 6 | 4 | 3 | 2 | 2 |
| 5-3 | 8 | 9 | 3 | 7 | 5 | 3 | 3 | 2 |
| 5-4 | 9 | 10 | 4 | 7 | 5 | 4 | 3 | 2 |
| 5-5 | 10 | 11 | 5 | 9 | 6 | 3 | 3 | 2 |
| 5-6 | 11 | 12 | 6 | 9 | 6 | 4 | 3 | 2 |
| 6-1 | 7 | 13 | 7 | 5 | 4 | 2 | 2 | 2 |
| 6-2 | 8 | 14 | 8 | 5 | 3 | 2 | 2 | 1 |
| 6-3 | 9 | 15 | 9 | 8 | 5 | 4 | 3 | 2 |
| 6-4 | 10 | 16 | 10 | 8 | 6 | 4 | 3 | 2 |
| 6-5 | 11 | 17 | 11 | 9 | 6 | 4 | 3 | 2 |
| 6-6 | 12 | 18 | 12 | 9 | 6 | 4 | 3 | 2 |

Figure 5:
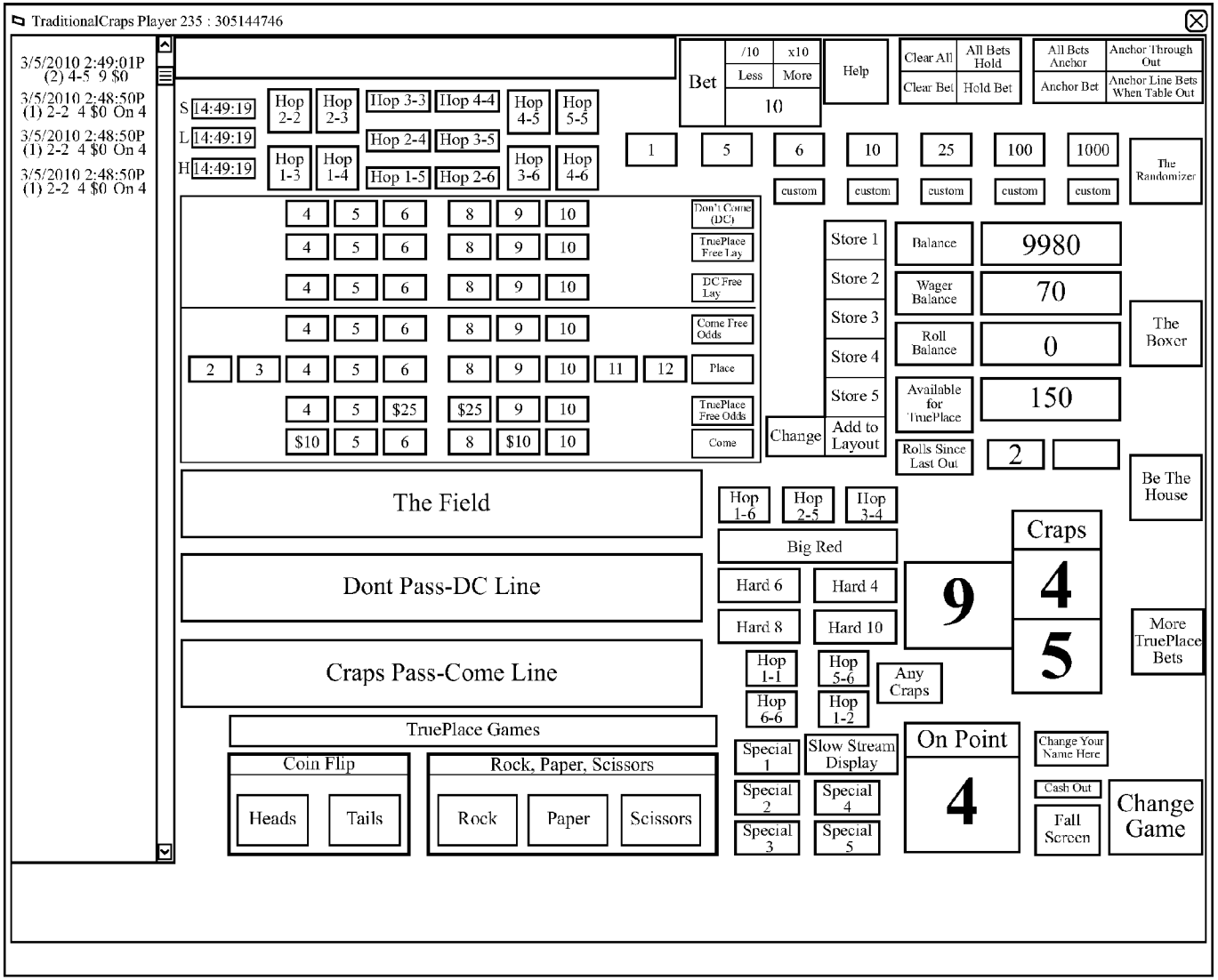
FIG. 5 is an exemplary screen shot of a computer-implemented method for playing two relatively simple games of chance simultaneously with a base game of Craps.

Alternatively, a 2-dice roll using indistinguishable dice can also be used to fairly determine the outcome of multiple games concurrently, including 1-to-2 and 1-to-3 range games. Perhaps more directly applicable to the preceding descriptions relating to traditional Craps games, the outcome of a 2-dice roll using indistinguishable dice can be mapped into the results of a 1-to-2 range game (such as "TruePlace Coin-Flip"), and into the results of a 1-to-3 range game (such as "TruePlace Rock-Paper-Scissors") all at the same time. FIG. 5 for example, shows an exemplary screen shot from a computer-implemented program that simultaneously administers games of Craps, Coin Flip, and Rock-Paper-Scissors, based on a two-dice random outcome generator. The outcome of a concurrent game of "TruePlace Rock-Paper-Scissors," in which, for example, the player bets on "Rock," would pay the player at the true odds of winning this bet, which is 1-to-1 if Scissors came up instead of "Paper". Similarly, the outcome of a concurrent game of "TruePlace Coin Flip," in which, for example, the player bet on "Heads," would be paid the true odds of wining this bet, which is 1-to-1 if Heads came up instead of Tails.

The motivation for casinos to offer true odds bets in all of the traditional games of Craps has always been to entice the player into making Line bets. The use of various mapping techniques disclosed in above-noted US 2010/0019447 combined with the use of the TruePlace bet invention disclosed herein opens vast possibilities in the design of a wide variety of games, all with the same classical underlying goal of enticing players into making Line bets. As described more completely in above-noted US 2010/0019447, new game combinations can be developed that appeal to players who do not understand the complexity of games like Craps and Roulette.

Figure 6:
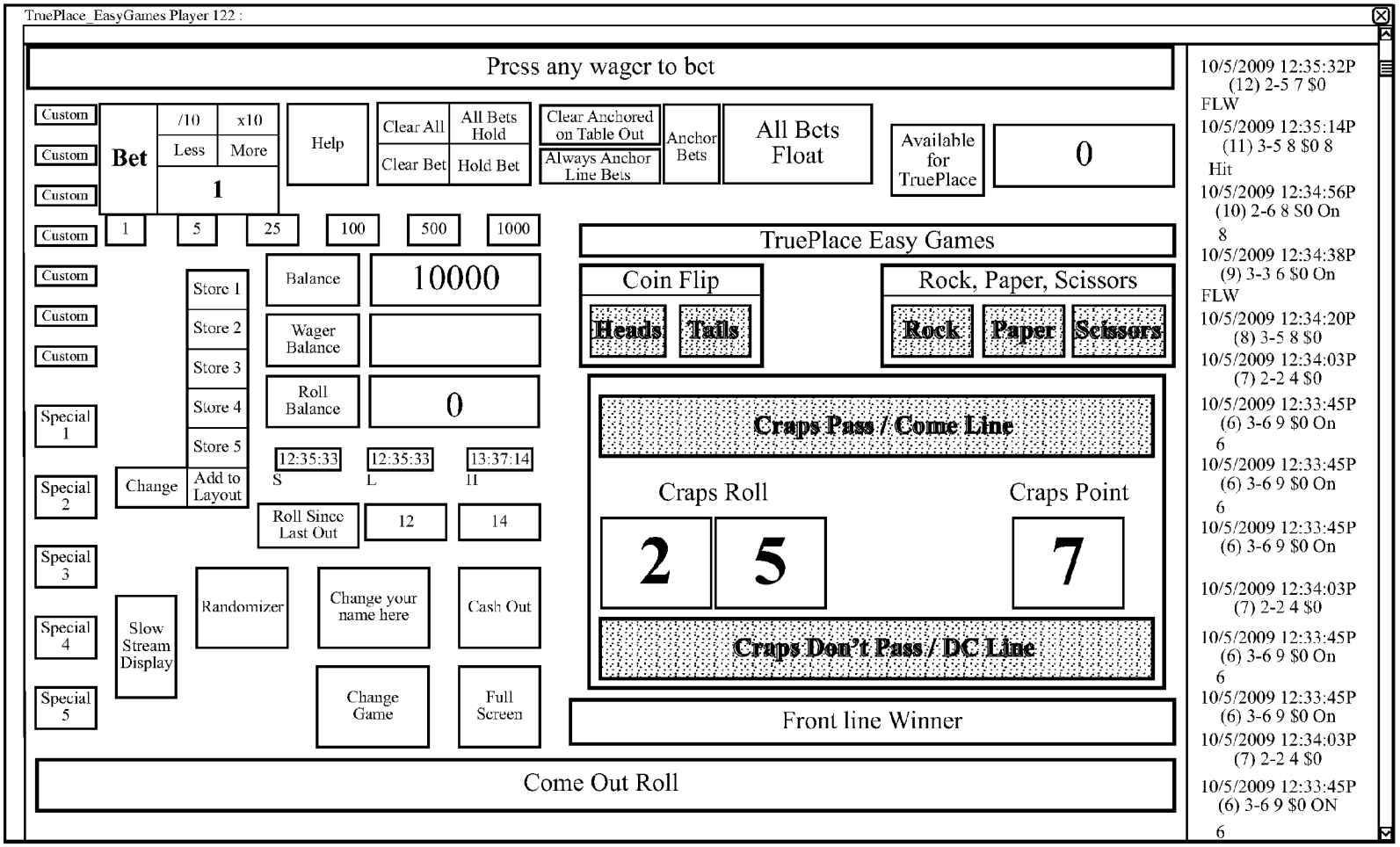
FIG. 6 is an exemplary screen shot of a computer-implemented method for playing any one of several different games of chance, either singly or simultaneously, in accordance with the TruePlace betting options of this invention.

For example, FIG. 6 is an exemplary screen shot of a software program implementing a simplified Craps game providing only the Come-Line and Don't-Come-Line flat wagers, and then offering only the games of TruePlace Rock-Paper-Scissors and TruePlace Coin-Flip as TruePlace continuation bets. Players of this game get to play the simple familiar games at true odds, and don't need to understand anything about Craps or any if its dozens of complex wagers. Using these techniques it is possible to create other very simple games of chance that are expected to appeal to certain types of players because of their simplicity and the fact that the familiar wagers made within them are paid out at true odds.

Figure 7:
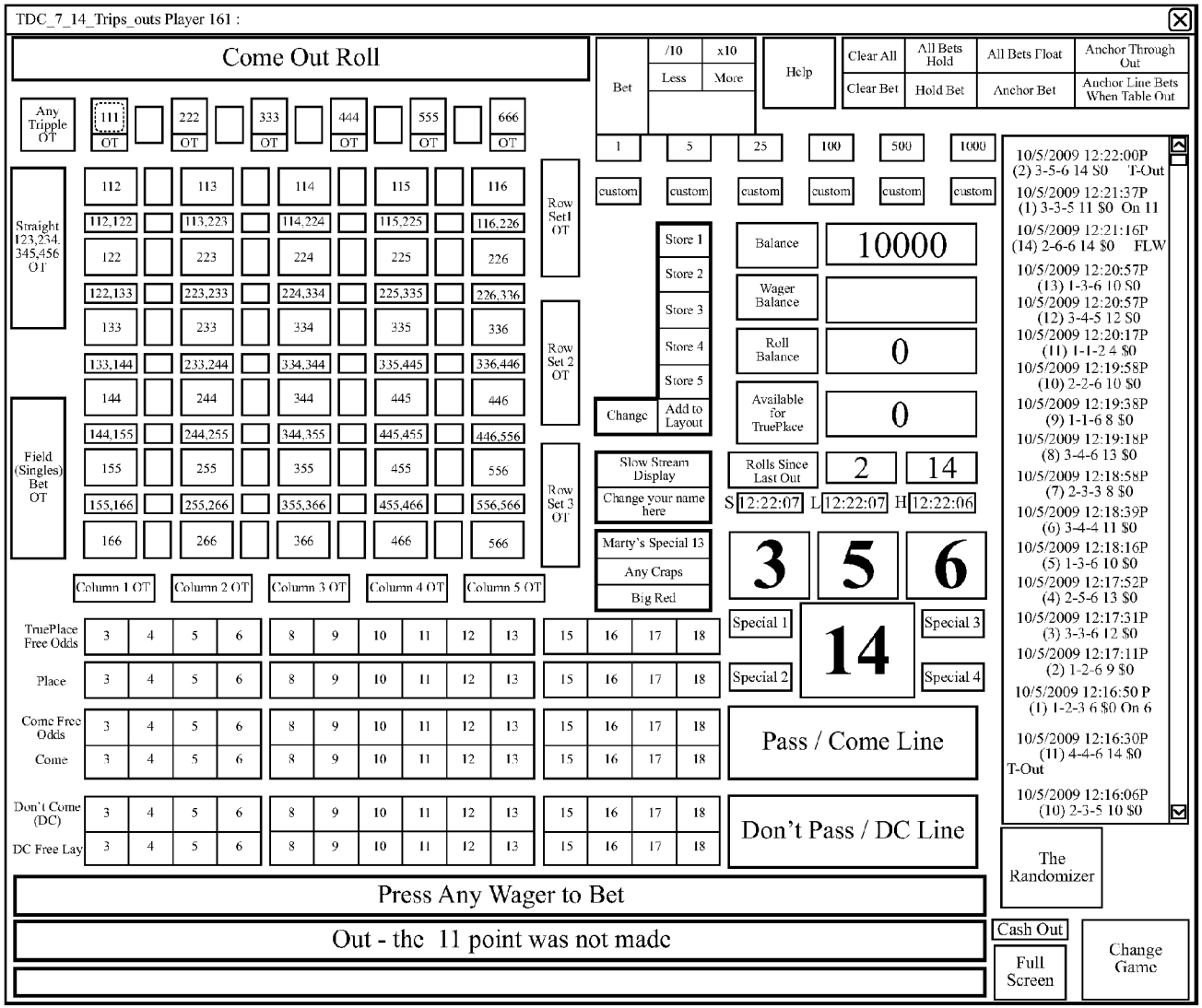
FIG. 7 is an exemplary screen shot of a computer-implemented method for playing a three-dice game of chance in accordance with the TruePlace betting options of this invention.
Figure 8:
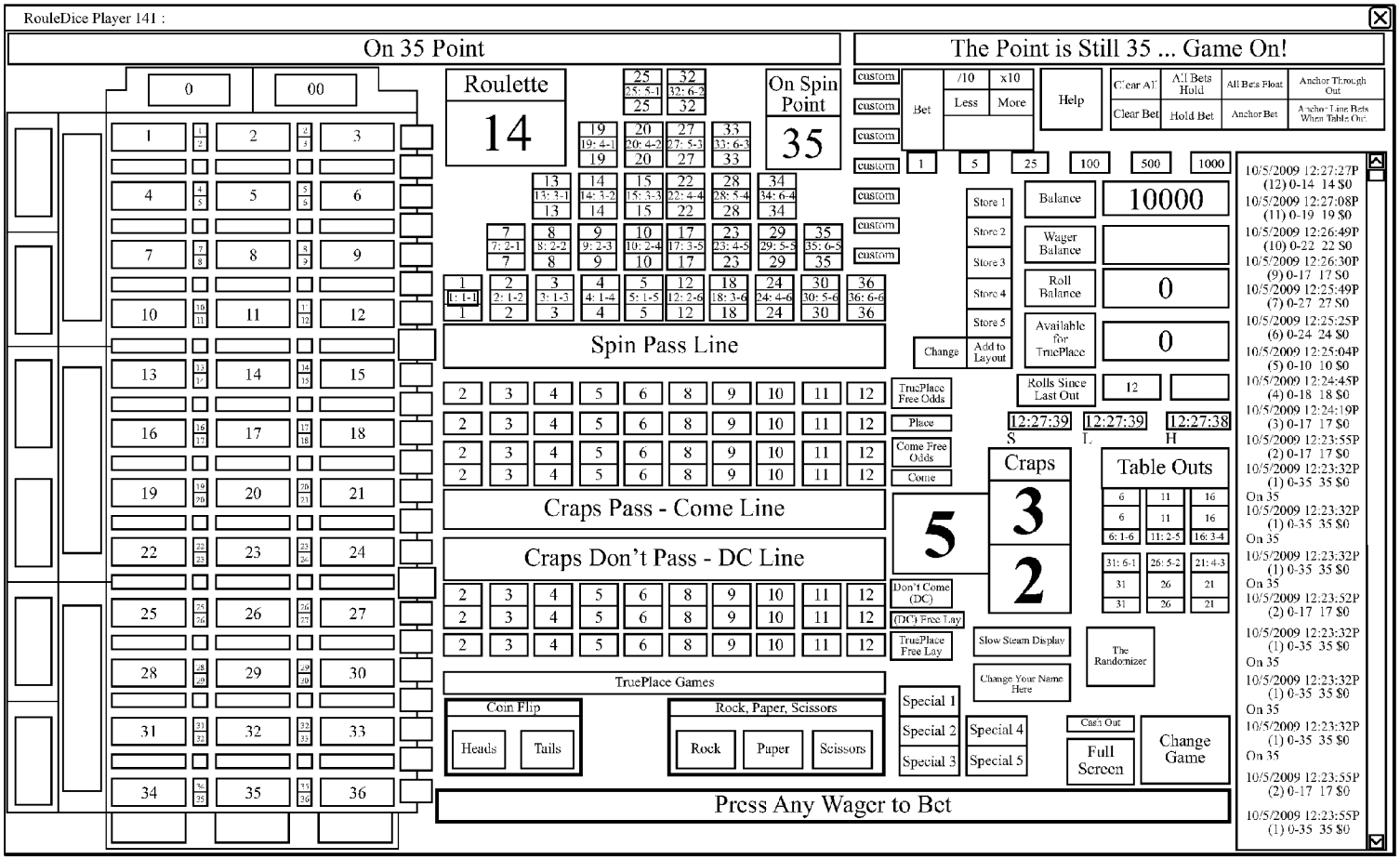
FIG. 8 is an exemplary screen shot of a computer-implemented method for playing roulette-style game of chance in accordance with the TruePlace betting options of this invention.

On the other end of the spectrum, US 2010/0019447 combined with the use of the TruePlace bets can be used to create extremely complex games such as "Three Dice Craps, 7,14, trips outs" and "RouleDice," as described in US 2010/0019447, and shown here in FIGS. 7 and 8. RouleDice showcases this technology by accepting a 1-to-38 wheel spin randomization to concurrently play: traditional Roulette, a modified game of traditional Craps that provides TruePlace bets in addition to true odds bets, TruePlace_CoinFlip, TruePlace_RockPaperScissors, as well as many other existing and future game methods. RouleDice uses its Craps Line bets to establish Craps Point numbers and feed the Pool of balance available for making TruePlace bets. As can be seen, RouleDice also uses a "Spin-Pass Line" bet for this same purpose, however, these come numbers are established as roulette spins that need to be repeated before the table-out spins are spun. "Three Dice Craps, 7, 14, Trips Outs uses a 3-indistinguishable dice randomization to play a game similar to traditional Craps. A similar set of familiar Pass/Don't Pass Line, and Come/DC Line bets establish point numbers. In each case, action on any of these Line bets feeds the pool of balance available for TruePlace bets, which is then universally used for all TruePlace bets in the entire layout, even those spanning into different games.

TruePlace Bet Persistency

Because many-to-many relationships exists between TruePlace wagers and the Flat wagers from which they continue, situations can occur during typical game play where the balance available for TruePlace bets can become a negative value. This is not possible in traditional true odds bets because of the 1-to-1 relationship between the Flat wagers and their associated true odds wagers. Traditionally, if the Flat bet wins, the true odds bet wins as well, and both are removed from the layout. However, as the following example shows, there can be situations in which a TruePlace bet remains booked after the Flat bet from which it continued has been resolved as a win, and removed from the layout. The following "TruePlace bet Persistency Example" corresponds initially to the above "TruePlace Variation of the Dilemma Example."

TruePlace Bet Persistency Example

A casino offers 10 times odds, meaning that 10 times the amount of the each of the committed Flat Bets is added into the "Amount Available For TruePlace bets" pool balance, and thus becomes available for betting on any or all of the TruePlace wagers provided in the game. A player makes a $10 bet on the Pass-Line wager during a Come-Out roll, and it is booked by the house when the dealer signals "All bets down." The shooter rolls a 4 as his Come-Out Roll, thus establishing 4 as the table's current Point Number, and committing the player's $10 Pass-Line bet to be won, lost, or surrendered upon subsequent action.

The formula for determining the balance available for TruePlace bets is calculated as: (The sum of (each committed Flat Bet TIMES the ratio defining the maximum true odds bet allowed for the particular Flat Bet)) MINUS (the sum of all TruePlace bets already booked). Thus, in this example, the TruePlace bet pool balance=$100=(The sum of (($10 Flat Bet on the Pass-Line for the current Point Number 4)*10)) MINUS ($0). The player is allowed to make up to $100 in TruePlace continuation bets among any and all of the TruePlace wagers provided in the game. The player opts to make a $25 TruePlace 6 Free Odds bet and a $25 TruePlace 8 Free Odds bet, and also makes a $10 Come-Line bet, and all of these bets are booked when the dealer signals "All bets down."

The shooter rolls a 9, and this does not affect the player's original $10 Pass-Line bet, or his $25 TruePlace 6 Free Odds bet, or his $25 TruePlace 8 Free Odds bet, but it does commit the $10 Come-Line bet to the number 9. This $10 bet is moved from the Come-Line wagering field on the table layout into the wagering field dedicated to the established Come Number 9, known as "Come 9," thus booking it.

The TruePlace bet pool balance formula is re-calculated. The new balance available for TruePlace bets now=$150=(The sum of (($10 Flat Bet on the Pass-Line for the current Point Number 4)*10) PLUS (($10 Flat Bet on the Come 9)*10)) MINUS ($25+$25). And so, at this juncture, the player is allowed to make up to an additional $150 in TruePlace continuation bets among any and all of the TruePlace wagers provided in the game. The player opts to make a $25 Press to the TruePlace 6 Free Odds bet, and a $25 Press to the TruePlace 8 Free Odds bet, so these 2 TruePlace bets are now $50 each, leaving $100 in the pool still available for TruePlace bets.

The player now has the following bets booked:

$10 Pass-Line (committed)

$50 TruePlace 6 Free Odds bet (allowed to be increased up to $150, reduced or removed)

$10 Come-9 (committed)

$50 TruePlace 8 Free Odds bet (allowed to be increased up to $150, reduced or removed)

At this point, the example departs from the earlier examples given. The shooter rolls a 9, and this resolves the player's Come-9 bet as a win, thus removing it from the layout. None of the remaining booked bets were lost, and so, the still has the following bets booked:

$10 Pass-Line (committed on the 4 Point)

$50 TruePlace 6 Free Odds bet $50 TruePlace 8 Free Odds bet

The Available Amount balance in the TruePlace bet pool is again re-calculated. The new balance available for TruePlace bets now=$0=(The sum of (($10 Flat Bet on the Pass-Line for the current Point Number 4)*10)) MINUS ($50+$50). Because the Come-9 was resolved, and the calculation now provides $0 available for TruePlace bets, the TruePlace bets he had booked still remain (persist), but he cannot increase them. The player now has the following list of bets booked:

$10 Pass-Line (committed)

$50 TruePlace 6 Free Odds bet (not allowed to be increased, can be reduced or removed)

$50 TruePlace 8 Free Odds bet (not allowed to be increased, can be reduced or removed)

The savvy player has already established TruePlace bets, and knows that no additional line bets are needed, so he opts to make no further bets.

The shooter then rolls a 4, and this resolves the player's Pass-Line bet as a win, thus removing it from the layout. Again, neither of the booked TruePlace bets were lost, so the player still has the following bets booked:

$50 TruePlace 6 Free Odds bet $50 TruePlace 8 Free Odds bet

The once again formula is re-calculated, and the balance available for TruePlace bets now=−$100=(The sum of (0)) MINUS ($50+$50).

The next roll is a Come-out roll, and the player continues his action. The TruePlace bets he still has booked have thus persisted after the Flat bets (which contributed to the pool from which these bets were derived) have been resolved and removed. By default, on the Come-out roll, TruePlace bets do not "work," as described below.

Under these circumstances, the player cannot add to the TruePlace bets because the balance available for TruePlace bets is now a negative number. The TruePlace bets, however, remain booked, and the player will continue to win on them until a 7 is thrown or they are removed. The astute player makes no changes, and the shooter then rolls a 10, which allows the player's TruePlace bets to "work." At this juncture this player is taking full advantage of the persistence feature, and now has TruePlace bets that remain established without having even one associated Flat bet. The only way to lose these persistent TruePlace bets is for the shooter to 7-out on an established Point.

The shooter throws an 8, and the player's TruePlace 8 bet wins $60 and remains booked. The shooter then throws a 7 and all of the player's bets are lost. Accordingly, the ability of TruePlace bets to persist after the Flat bet(s) have been resolved is another advantage of these TruePlace betting options. This advantage makes the TruePlace bets of this invention more interesting and more profitable than the prior art true odds bets. Because of this "persistence" feature embodied within the TruePlace bets concept of this invention, games offering TruePlace bets can easily swing their overall house edge to nearly zero, and in some situations, even develop a negative house edge. The ability to spread TruePlace bets across multiple bets here plays a contributing factor, along with the fact that they payout at true odds. Examples of how this can occur are perhaps best explained by reference to various "Hedging" strategies, as widely known to those skilled in the art. In an effort to control the impact of these advantages, TruePlace bets can be structured so as not to be allowed on Come-out rolls. If they are allowed to work on Come-out rolls, those skilled in the art can use Hedging strategies to even greater advantages (to the greater disadvantage of the house providing these wagers).

Use of TruePlace Bets in Player Rewards Systems

Another use for TruePlace bets is as a vehicle for providing varying degrees of extremely thin, non-existent, or even negative house advantages in new games, or as enhancements to traditional games like Craps and Roulette. The following patents from Signature Gaming, L.L.C. describe player rewards systems that feature "Intrinsic Rewards," meaning rewards paid in the form of better payback odds wagers being made available, vs. "Extrinsic Rewards" like free drinks, food, rooms, etc: U.S. Ser. No. 12/268,937 SYSTEM AND METHOD FOR UTILIZING ACCUMULATED REWARDS FOR GAME PLAY, filed Nov. 11, 2008; and U.S. Ser. No. 12/267,075 SYSTEM AND METHOD FOR PROVIDING ELECTRONIC GAMING MACHINES WITH VARIABLE PAYOUTS BASED ON RANDOM EVENTS, filed Nov. 7, 2008. The entire disclosures of U.S. Ser. Nos. 12/268,937 and 12/267,075 are hereby incorporated by reference and relied upon.

Intrinsic player rewards can be offered either as new bets explicitly created for this purpose (also known as "Bonus Bets"), or, wagers existing in traditional games can be modified to provide better paybacks without otherwise modifying these games. By making more TruePlace wagers available, and/or by increasing the maximum true odds wagering ratios upon which TruePlace bets operate, and/or by allowing TruePlace bets to be persistent, and/or by allowing TruePlace bets to work on Come-out rolls, additional intrinsic player rewards strategies become available.

For example, multiple versions of a game of traditional Craps can be made available to be simultaneously played against the same live dice rolls, as provided by U.S. Ser. No. 12/465,240, in which each version offers better and better paybacks by making more and more of the existing true odds bets available as TruePlace bets, by offering higher maximum true odds betting ratios, and by offering TruePlace bets to work on come-out rolls. Restrictions can be imposed upon the availability of these various game versions, based upon first-come-first served, player wagering history, the current status of the players according to external player rewards systems, and/or any combinations of these or other features. Players of such configurations may desire to play the versions with better paybacks, and thus would be encouraged to extend their playing time; similar to ways they may be encouraged to increase their play in extrinsic rewards configurations.

Alternatively, new games can be designed or traditional games can be modified to provide varying degrees of enhanced paybacks throughout the course of play by making more TruePlace wagers available, and/or by increasing the maximum true odds betting ratios, and/or by allowing TruePlace bets to work on Come-out rolls. For example, a variation of the game RouleDice, called "Tower of Power RouleDice," offers various wagers providing Normal Game Payouts (NGPs), True Game Payouts (TGPs) and varying degrees of Higher Game Payouts (HGPs), including even NEGATIVE house advantages, when bets are made on the Spin Pass-Line wager and to the wagers for the roulette mappings. The terms NGP, TGP and HGP are more fully defined in the above-noted patent documents owned by Signature Gaming, L.L.C. In brief, however, Normal Game Payouts (NGPs) refers to the traditional payouts used in traditional games like Craps and Roulette. True Game Payouts (TGPs) refers to traditional and new games in which bets are available that payout at true odds, meaning that the payouts reflect the actual probability of achieving the results being wagered upon. Higher Game Payouts (HGPs) refers to traditional games in which modifications to certain wagers are provided in order to decrease the house edge to be less than their traditional payouts. As the game progresses, these enhanced paybacks are provided in response to player wagering history, the current status of players according to external player rewards systems, and/or combinations of these. Games such as "Tower of Power RouleDice" can thus use TruePlace bets as a vehicle to implement such intrinsic rewards.

Put Bets Used with TruePlace Wagers

The "Put Bet" in traditional Craps games allows a player to essentially make a Pass-Line Bet or Come Bet on an already established number. I.e., a Put Bet is placed without going through a Come-out roll. For example, if the shooter has already established a 4 as the Point, any player can then make a Put Bet upon the pass line. It is to the generally understood disadvantage of the player to do so, however, because he is making a bet at an already great disadvantage. Namely, in this example, a 4 must be rolled before a 7, which translates to a substantial 2-to-1 disadvantage for a bet that pays even money. However, Put Bets have been demonstrated to have usefulness in certain limited circumstances if the player makes them in conjunction with traditional true odds bets at large. These advantages are now even more attractive with the TruePlace bets provided by this invention.

As an example, one may suppose a casino offering 10 times odds. By making a $10 Put Bet on the 4 Point, the player can then make an associated $100 true odds bet, and this makes the overall payout potential of these two bets combined=$210=($10×1)+($100×2). Mathematically, this option is better than if the player had made a $110 Place Bet on the 4 Point that offers a payout potential of only $198=$110×9/5. Thus, using the Put Bet instead of a Place Bet, a 1.2% profit advantage can be realized. In a casino offering 100 times odds, the advantage is even more pronounced. In this same example, the player enjoys a payout potential of $2010=($10×1)+($1000×2). This can be compared with a payout potential for the Place Bet option of only $1818. The profit advantage is therefore 192/1818, or 10.6% better than with traditional Place Bets. Accordingly, Put Bets provide a way for the player to take better advantage of the maximum odds offered by the house. In addition, traditional Put Bets provide a method by which the player can choose which numbers to bet on, which is a goal shared with TruePlace bets.

One implication of Put Bets is that once the player makes them, they become instantly committed, and cannot be reduced or removed, much like any established Come bet cannot be reduced or removed. Once a Put Bet is made, the player must wait for the outcome. Another implication in making Put Bets, not enabled in any other bets offered in traditional Craps games, can be understood as an "Instant Booking" effect. When the Put Bet is placed, the player can then instantly make the associated true odds bet. Since he is able to do so, the Put Bet can be understood to have been "instantly" booked. Considering all of the other bets in traditional Craps games, there is no comparable instantly booked bet. Rather, in traditional Craps games, true odds bets can only be made after a Point has been established by rolling the dice. So, a dice roll must occur between the posting of the flat bet and the time the player can then make the true odds bet. Only with Put Bets, can a player immediately bet on the associated true odds bet.

Figure 9:
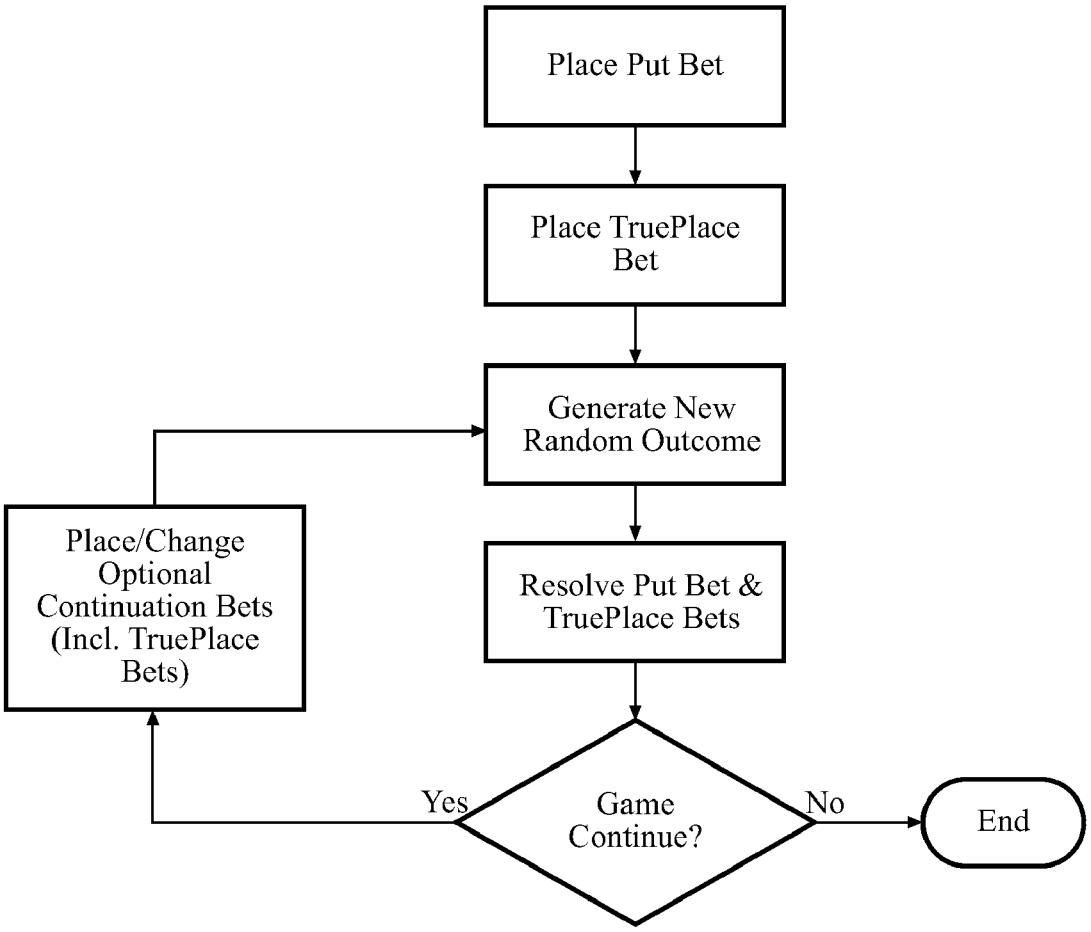
FIG. 9 is a flow chart describing a method for playing a game of chance including a Put Bet feature according to this invention.

An exemplary flow chart describing a method for playing a game of chance including a Put Bet feature according to this invention is provided in FIG. 9. As will be appreciated, the Put Bet can have a positive impact on the TruePlace bets concepts of this invention. By making Put Bets available to the TruePlace betting pool instantly, a player can make the Put Bet and then instantly make any number of TruePlace bets without having to wait for a dice roll to occur. Without Put Bets and the ability of the system to accept, book and commit these bets and update the available balance for TruePlace bets, all instantly, players would otherwise need to wait at least one betting cycle before any of the TruePlace bets can be made.

This feature of Put Bets will make TruePlace bets even more appealing, especially for players desiring a simpler game. The use of TruePlace betting in conjunction with the ability to provide many multiply-mapped concurrent games featuring many TruePlace bets makes this an attractive feature for those players looking for simple games with bets paying true odds. Players do not have to understand the relatively complex concepts of Come-out rolls vs. on-Point rolls, etc., in order to play and enjoy familiar true odds bets like TruePlace_CoinFlip or TruePlace_RockPaperScissors.

In summary, the invention referred to as TruePlace bets is a betting method used in a variety of games of chance. The method can be used to enhance existing games of chance such as Craps and roulette, with bets that offer extremely slim house edges, and it can also be used to enhance new games that offer extremely simple rules and familiar bets such as "Coin-Flip" and "Rock-Paper-Scissors," as well as those having relatively complex rules such as Three Dice Craps, 7,14, trips outs and RouleDice. In addition, this method can be used as a vehicle to implement new and innovative strategies to offer player rewards intrinsically made via better player payouts, as opposed to extrinsic rewards such as free drinks, meals, entertainment, lodging and the like.

The invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A method for playing a game of chance having various wagering options, said method comprising, the steps of:

A. Providing a first game of chance having an outcome determined by the selection of a number within a first number range;

providing a second game of chance different than the first game of chance, the second game of chance having an outcome determined by the selection of a number within a second number range;

providing an input data set defined as numbers derived from all possible outcomes of a given randomizer machine, the input data set being dissimilar to at least one of the first and second number ranges;

providing a randomizer machine configured to randomly select a number from the input data set;

creating a first data map associating each number in the first number range with a number in the input data set;

creating a second data map associating each number in the second number range with a number in the input data set;

placing a wager on the first game of chance;

placing a wager on the second game of chance;

obtaining a number from the randomizer machine;

mapping the number from the randomizer machine to a number in the first number range using the first data map;

mapping the number from the randomizer machine to a number in the second number range using the second data map; and concurrently resolving the first and second games of chance based on the input data from the randomizer machine, whereby a plurality of disparate games of chance can be predictably decided on the basis of a common randomization event;

B. Said steps of placing a wager including: Providing a plurality of wagering options each based on a forecast for a particular outcome from the defined set, each wagering option guaranteeing a return in the event of a win determined by a pre-set payout ratio multiplied by a value placed at risk, the wagering options including 1) at least one Flat bet (FB) in which the pay-out ratio is less than the probability of the forecasted outcome being randomly generated, and 2) at least one TruePlace bet (TP) in which the pay-out ratio is equal to the probability of the forecasted outcome being randomly generated;

C. Providing at least one player;

D. Receiving from the player at least one Flat bet (FB) and an accompanying value at risk;

E. Receiving, from the player at least one TruePlace bet (TP) and an accompanying value at risk;

F. Randomly generating an outcome from the defined set of possible outcomes;

G. Comparing the generated outcome to the Flat bet (FB) and TruePlace bet (TP), and then determining whether each respective bet (FB, TP) is won, lost or unresolved; and H. the forecasted outcome for the TruePlace bet (TP) being dissimilar to the forecasted outcome for the Flat bet (FB), whereby the TruePlace bet (TP) is not directly associated with the Flat bet (FB) such that the generated outcome may yield a different resolution for the TruePlace bet (TP) and the Flat bet (FB).

2. The method of claim 1 wherein the Flat bet (FB) cannot be changed until won or lost.

3. The method of claim 2 wherein the value placed at risk accompanying the TruePlace bet (TP) is less than or equal to the Flat bet (FB) times the predetermined maximum betting ratio ($r_{FB}$).

4. The method of claim 1, further including the step of subsequently changing the value placed at risk for the at least one TruePlace bet (TP) if said comparing step yields a unresolved outcome.

5. The method of claim 1, further including the steps of:

A. establishing a TruePlace Pool for the player equal to the sum of the player's concurrent Flat bets (FB) multiplied by a predetermined maximum betting ratio ($r_{FB}$); and B. limiting the aggregate value placed at risk for the TruePlace bet (TP) to an amount not exceeding the TruePlace Pool minus all prior TruePlace bets concurrently booked ($TP_B$).

6. The method of claim 5, further including the step of re-calculating the TruePlace Pool after each wagering change made by the player.

7. The method of claim 5, further including repeating said randomly generating steps and comparing steps, and then re-calculating the TruePlace Pool.

8. The method of claim 1, wherein said comparing step results in a resolution for the Flat bet (FB) but the TruePlace bet (TP) remains unresolved, wherein the TruePlace bet (TP) persists after the Flat bet (FB) has been resolved.

9. The method of claim 1, wherein said step of receiving from the player at least one Flat bet (FB) and at least one TruePlace bet (TP) includes receiving the Flat bet (FB), generating an initial outcome, comparing the initial outcome to the Flat bet (FB) and then determining whether the Flat bet (FB) is a win, a loss or unresolved; and receiving the TruePlace bet (TP) only if the Flat bet (FB) is unresolved.

10. The method of claim 1, wherein said step of providing at least one game of chance includes providing first and second distinct games of chance and said step of randomly generating an outcome simultaneously resolves the first and second games, and further wherein said the at least one Flat bet (FB) is associated with the first game and the at least one TruePlace bet (TP) is associated with the second game.

11. The method of claim 10, wherein first game is Craps.

12. The method of claim 1, wherein the at least one TruePlace bet (TP) is made available to the player as an intrinsic reward.

13. A method for playing a game of chance having various wagering options, said method comprising the steps of:

A. Providing a first game of chance having an outcome determined by the selection of a number within a first number range;

providing a second game of chance different than the first game of chance, the second game of chance having an outcome determined by the selection of a number within a second number range;

providing an input data set defined as numbers derived from all possible outcomes of a given randomizer machine, the input data set being dissimilar to at least one of the first and second number ranges;

providing a randomizer machine configured to randomly select a number from the input data set;

creating a first data map associating each number in the first number range with a number in the input data set;

creating a second data map associating each number in the second number range with a number in the input data set;

placing a wager on the first game of chance;

placing a wager on the second game of chance;

obtaining a number from the randomizer machine;

mapping the number from the randomizer machine to a number in the first number range using the first data map;

mapping the number from the randomizer machine to a number in the second number range using the second data map; and concurrently resolving the first and second games of chance based on the input data from the randomizer machine, whereby a plurality of disparate games of chance can be predictably decided on the basis of a common randomization event;

B. Said steps of placing a wager including: Providing a plurality of wagering options each based on a forecast for a particular outcome from the defined set, each wagering option guaranteeing a return in the event of a win determined by a pre-set payout ratio multiplied by a value placed at risk, the wagering options including 1) A plurality of Flat bets (FB) in which each pay-out ratio is less than the probability of the respective forecasted outcomes being randomly generated and 2) A plurality of TruePlace bet (TP) in which the pay-out ratio is equal to the probability of the respective forecasted outcomes being randomly generated;

C. Providing at least one player;

D. Receiving from the player at least one Flat bet (FB) selected from the plurality of Flat bets (FB) and at least one TruePlace bet (TP) selected from the plurality of TruePlace bets (TP), and booking the bets;

E. Randomly generating an outcome from the defined set of possible outcomes;

F. Comparing the outcome to the least one Flat bet (FB) and the at least one TruePlace bet (TP) and then determining whether each respective bet is won, lost or unresolved; and G. establishing TruePlace bets pool for the player according to the formula:

$$\text{TruePlace Pool}=\Sigma(FB*r_{FB})$$

Where:

FB=each committed Flat bet, and $r_{FB}$=the ratio defining the maximum TruePlace bet allowed for the particular Flat bet (FB).

14. The method of claim 13, further including the step of limiting the aggregate value placed at risk for the TruePlace bet (TP) to an Amount Available For TruePlace bets defined by the formula:

$$\text{Amount Available For TruePlace bets}=\text{TruePlace Pool}-\Sigma(TP_B)$$

Where:

$TP_B$=TruePlace bets already booked.

15. The method of claim 13, further including the step of subsequently changing the value placed at risk for the at least one TruePlace bet (TP) if said comparing step yields a unresolved outcome.

16. The method of claim 13, further including repeating said randomly generating steps and comparing steps, and then re-calculating the Amount Available For TruePlace bets.

17. The method of claim 13, wherein said comparing step results in a resolution for the Flat bet (FB) but the TruePlace bet (TP) remains unresolved, wherein the TruePlace bet (TP) persists after the Flat bet (FB) has been resolved.

18. The method of claim 13, wherein said step of receiving from the player at least one Flat bet (FB) and at least one TruePlace bet (TP) includes receiving the Flat bet (FB), generating an initial outcome, comparing the initial outcome to the Flat bet (FB), and then determining whether the Flat bet (FB) is a win, a loss or unresolved; and receiving the TruePlace bet (TP) only if the Flat bet (FB) is unresolved.

19. The method of claim 13, wherein said step of providing at least one game of chance includes providing first and second distinct games of chance and said step of randomly generating an outcome simultaneously resolves the first and second games, and further wherein said the at least one Flat bet (FB) is associated with the first game and the at least one TruePlace bet (TP) is associated with the second game.

20. The method of claim 13, wherein the at least one TruePlace bet (TP) is made available to the player as an intrinsic reward.

21. A method for playing a game of chance having various wagering options, said method comprising the steps of:

A. Providing a first game of chance having an outcome determined by the selection of a number within a first number range;

providing a second game of chance different than the first game of chance, the second name of chance having an outcome determined by the selection of a number within a second number range;

providing an input data set defined as numbers derived from all possible outcomes of a given randomizer machine, the input data set being dissimilar to at least one of the first and second number ranges;

providing a randomizer machine configured to randomly select a number from the input data set;

creating a first data map associating each number in the first number range with a number in the input data set;

creating a second data map associating each number in the second number range with a number in the input data set;

placing a wager on the first game of chance;

placing a wager on the second game of chance;

obtaining a number from the randomizer machine;

mapping the number from the randomizer machine to a number in the first number range using the first data map;

mapping the number from the randomizer machine to a number in the second number range using the second data map; and concurrently resolving the first and second games of chance based on the input data from the randomizer machine, whereby a plurality of disparate games of chance can be predictably decided on the basis of a common randomization event;

B. Said steps of placing a wager including: Providing a plurality of wagering options each based on a forecast for a particular outcome from the defined set, each wagering option guaranteeing a return in the event of a win determined by a pre-set payout ratio multiplied by a value placed at risk, the wagering options including 1) at least one Flat bet (FB) in which the pay-out ratio-is less than the probability of the forecasted outcome being randomly generated, wherein the Flat bet (FB) cannot be changed until won or lost, and 2) at least one TruePlace bet (TP) in which the pay-out ratio is equal to the probability of the forecasted outcome being randomly generated;

C. Providing at least one player;

D. Receiving from the player at least one Flat bet (FB) and an accompanying value at risk;

E. Receiving from the player at least one TruePlace bet (TP) and an accompanying value at risk, the value placed at risk accompanying the TruePlace bet (TP) being less than or equal to the Flat bet (FB) times a predetermined maximum betting ratio ($r_{FB}$);

F. Randomly generating an outcome from the defined set of possible outcomes;

G. Comparing the generated outcome to the Flat bet (FB) and TruePlace bet (TP), and then determining whether each respective bet (FB, TP) is won, lost or unresolved;

H. establishing an Amount Available For TruePlace bets for the player according to the formula:

$$\text{Amount Available For TruePlace bets} = \Sigma(FB * r_{FB}) - \Sigma(TP_B)$$

Where:

FB=each committed Flat bet $r_{FB}$=the ratio defining the maximum TruePlace bet allowed for the particular Flat bet (FB)

$TP_B$=TruePlace bets already booked repeating said randomly generating steps and comparing steps, and then re-calculating the TruePlace Pool.

* * * * *